US005630521A

United States Patent [19]

Waddell et al.

[11] Patent Number: 5,630,521

[45] Date of Patent: May 20, 1997

[54] ERGONOMIC UPRIGHT WHEELED LUGGAGE

[75] Inventors: Charles E. Waddell, Bristol; Andrew Zionts, Providence, both of R.I.; William L. King, Denver, Colo.; Roland E. Mongeau, Cumberland, R.I.; David Crumrine, Denver, Colo.

[73] Assignee: Samsonite Corporation, Denver, Colo.

[21] Appl. No.: 636,595

[22] Filed: Apr. 23, 1996

Related U.S. Application Data

[60] Provisional application No. 60/007,454, Nov. 22, 1995, and provisional application No. 60/013,068, Mar. 8, 1996.

[51] Int. Cl.[6] ..... A45C 13/00

[52] U.S. Cl. ..... 190/18 A; 190/115; 280/47.26

[58] Field of Search ..... 190/18 A, 115; 280/47.26, 47.29; 16/115

[56] References Cited

U.S. PATENT DOCUMENTS

| | | |
|---|---|---|
| 1,099,933 | 6/1914 | Pohrer . |
| 1,616,632 | 2/1927 | Mastrontonio . |
| 1,913,295 | 6/1933 | Schreck . |
| 2,002,836 | 5/1935 | Rossi . |
| 2,291,984 | 8/1942 | Ponselle . |
| 2,422,862 | 6/1947 | Stottrup . |
| 2,477,294 | 7/1949 | Fuller . |
| 2,596,578 | 5/1952 | McIntyre . |
| 2,733,930 | 2/1956 | Putterman . |
| 2,786,692 | 3/1957 | Timpson . |
| 3,170,709 | 2/1965 | Shackel . |
| 3,321,213 | 5/1967 | Shoffner . |
| 3,325,183 | 6/1967 | Elchuck . |

(List continued on next page.)

FOREIGN PATENT DOCUMENTS

| | | |
|---|---|---|
| 684519 | 4/1964 | Canada . |
| 2096797 | 11/1993 | Canada . |
| 968949 | 5/1954 | France . |
| 2056657 | 5/1972 | Germany . |
| U9101536 | 5/1991 | Spain . |
| U9302636 | 10/1993 | Spain . |
| U9400276 | 2/1994 | Spain . |

OTHER PUBLICATIONS

Advertisement, "Atlantic Products' 4×4 Four Wheel Drive," Showcase Magazine, Apr./May 1995, p. 79; vol. 20, No. 2; Published by Luggage & Leather Goods Manufacturers of America.

Article, "Atlantic Introduces 4×4 Four Wheel Drive," Showcase Magazine, Apr./May 1995, p. 164; vol. 20, No. 2; Published by Luggage & Leather Goods Manufacturers of America.

Advertisement, "Remin Kart–A–Bag Carts", Showcase Magazine, Feb./Mar. 1995, p. 50; vol. 20, No. 1; Published by Luggage & Leather Goods Manufacturers of America.

Advertisement, "Rollin' Donkey," Bowling Magazine, Dec./Jan. 1993, page unknown.

Advertisement, Boyt "Glider Overseas," Boyt Company Catalog, 1995–1996, p. 18 Published by Boyt Company, Iowa Falls, Iowa.

*Primary Examiner*—Allan N. Shoap
*Assistant Examiner*—Christopher J. McDonald
*Attorney, Agent, or Firm*—Rod D. Baker; Gregory W. O'Connor

[57] ABSTRACT

A wheeled upright luggage case is disclosed. The best embodiment of the case has wheels to allow the case to stand upright in a stable and balanced position without attendance by the user. The case has a wheel handle to allow the user to push or pull the case across a supporting surface. The case may be pushed or pulled on either four wheels or two wheels. When four wheels are used, the full weight of the case and its contents are borne by the wheels, relieving the user from having to bear with her arm any of the weight of the luggage. The body of the case is designed to have a specific range of tilt angles from the vertical; by tilting the body of the case toward the user, the design of the case improves the stability of the case while it is pushed across a supporting surface on four wheels. Various case body configurations and push handle arrangements are disclosed.

85 Claims, 10 Drawing Sheets

U.S. PATENT DOCUMENTS

| | | | |
|---|---|---|---|
| 3,655,212 | 4/1972 | Krass . | |
| 3,861,703 | 1/1975 | Gould . | |
| 4,222,145 | 9/1980 | Lowder . | |
| 4,254,850 | 3/1981 | Knowles . | |
| 4,311,222 | 1/1982 | Castanier . | |
| 4,537,414 | 8/1985 | Nusbaum . | |
| 4,679,670 | 7/1987 | Wickman . | |
| 4,728,245 | 3/1988 | Shelton . | |
| 4,822,070 | 4/1989 | Korona . | |
| 4,848,782 | 7/1989 | Schmidt | 190/18 A X |
| 5,013,055 | 5/1991 | Labrum | 280/47.26 X |
| 5,040,811 | 8/1991 | Buskin . | |
| 5,044,476 | 9/1991 | Seynhaeve . | |
| 5,339,934 | 8/1994 | Liang . | |
| 5,377,795 | 1/1995 | Berman | 280/47.26 X |
| 5,407,039 | 4/1995 | Alper . | |
| 5,433,463 | 7/1995 | Finley . | |
| 5,573,089 | 11/1996 | Liang . | |

ERGONOMIC UPRIGHT WHEELED LUGGAGE

CROSS REFERENCE TO RELATED APPLICATIONS

This application claims priority to U.S. Provisional patent application Ser. No. 60/007,454, filed on Nov. 22, 1995, and to U.S. Provisional patent application Ser. No. 60/013,068, filed on Mar. 8, 1996, the teachings of which are hereby incorporated by reference.

BACKGROUND OF THE INVENTION

1. Field of the Invention

The invention relates generally to luggage, particularly to wheeled luggage. The invention allows luggage to be wheeled along a supporting surface while "upright," e.g., with the major axis of the luggage mostly vertical relative to the supporting surface, but also while reducing fatigue on the user's arms.

2. Background Art

Wheeled luggage cases have developed rapidly over recent decades. As early as the late nineteenth century, patent literature showed large wooden trunks with small metal wheels built into wood strips or skids. Conventional suitcases having horizontal major axes and either two or four wheels have been the standard of the industry for years. These cases, known as "pullman" cases, have the wheels attached to the bottom wall of the case. They are towed on these wheels by a strap or handle attached on an end wall near an upper corner of the case.

A conventional wheeled pullman has two fixed-axis wheels on the bottom. These are spaced from one another along the relatively narrow width dimension of the case to support the back end of the case. A pair of caster type wheels support the front end of the case. The user pulls the case around on these four wheels as if it were a rather narrow, tall wagon.

Another type of pullman, popularized by Samsonite Corporation, is known by the trademark "Cartwheels". This case has two fixed axis wheels mounted at a lower, rear edge of the bottom face of the case, and a pair of glides (small plastic or rubber legs), attached on the bottom near the front edge thereof. An elongated handle is mounted on a pivot axle on the upper portion of the front wall of the case. This handle is normally held flush against this wall when not in use. The axle mount includes an abutment against which the pivot end of the handle bears when the handle pivots to its outward most position that holds the handle outward from the case when it is pivoted from the stored position. In this position, the user can hoist the front of the case up, thus lifting the glides off the floor so that the case can be rolled on the back wheels.

Another style of wheeled, upright luggage case has a pair of fixed axis wheels spaced along a long edge of the lower face. These wheels are oriented so that the case is rolled broadside. The upper face of the case has a handle with which the user balances the case on these two wheels. One such case, popularized under the trademark "Piggyback" by Samsonite Corporation, incorporates luggage cart functions into this type of two wheeled case. Here, the wheeling handle is on an arm that slides upward out of the case to a convenient position. The user tips the case onto the wheels while simultaneously suspending an auxiliary case from the strapping device on a handle.

U.S. Pat. No. 1,757,490 to Tibbetts shows a wheeled hand truck that may be used to transport suitcases, but does not suggest tilting the truck's frame to improve stability and comfort while leaving four wheels in contact with the ground.

U.S. Pat. No. 2,596,578 to McIntyre, et al., discloses a suitcase with one pair of wheels to assist the user in carrying it along in an upright position. The suitcase cannot stand independently upright; the user must support and balance the case.

U.S. Pat. No. 3,861,703 to Gould discloses a way to mount four wheels on the bottom of an upright suitcase in order to roll it across a supporting surface. The case is not tipped during transport.

U.S. Pat. No. 4,679,670 to Wickman shows an upright wheeled suitcase, but the major axis of the case is perpendicular to the ground, which may reduce dynamic stability.

U.S. Pat. No. 5,044,476 to Seynhaeve discloses a suitcase that may be wheeled along in an upright position, but no particular angle of tilt is indicated as being desirable.

A need remains for an upright wheeled case that is stable when rolled and yet does not demand constant manual support by the user, with the resultant stress on the user's arm.

SUMMARY OF THE INVENTION

The invention relates generally to luggage, especially to luggage that is wheeled across a supporting surface in an upright position. Disclosed is a wheeled upright luggage case of the type described whose generally parallelepiped body has a depth dimension and a width dimension, each of which is less than its height dimension, at least a pair of wheels spaced long the width dimension normally located along a back corner portion of the bottom of the body, and a pull handle mounted at an upper end of the body for moving the case on the wheels along a supporting surface; the luggage case has a center of gravity about in the geometric center of the body, and at least one other wheel mounted on the bottom of the body at a distance along the depth dimension forward of the pair of wheels, the other wheel mounted on the case such that the major axis of the body, when the body is resting on the other wheel and the pair of wheels, tilts at an angle from vertical. A vertical line passing through the center of gravity falls between the pair of wheels and the other wheel, whereby the case can stand unattended on the wheels and pushed or pulled by the handle on at least some of the wheels. Preferably, this angle from the vertical is from about nine degrees to about twelve degrees. The handle preferably comprises a handle grip and is mounted on at least one elongated rod to place the handle grip in a convenient position for the user. This elongated rod preferably extends from the body at an angle from the vertical from about forty degrees to about forty-five degrees. The elongated rod may be mounted to extend in parallel relationship with the major axis of the body, but is preferably mounted on the body to selectively pivot to a use position forming an angle with the vertical of about forty-two degrees when the major axis of the body is tilted at the most preferred angle of about ten degrees from the vertical. Disclosed alternative handles and body configurations are within the scope of the invention.

A primary object of the invention is to provide a luggage apparatus that allows the user to wheel the luggage in an upright position across a supporting surface with a minimum amount of weight borne by the user's arms.

Another object of the invention is to provide a luggage apparatus that is stable while being wheeled across a supporting surface.

Another object of the invention is to provide an upright wheeled luggage apparatus that may be pushed along a supporting surface on its wheels.

A primary advantage of the invention is that it permits the user to wheel upright luggage across a supporting surface without the need to constantly manually support and stabilize the luggage.

Another advantage of the invention is that it provides a case that is normally in a wheelable position, and does not need to be manually tilted into wheeling position.

Another advantage of the invention is that it minimizes the amount of luggage weight borne by the user's wrists, elbows, and shoulders, and allows the user to move the luggage without placing the user's arm(s) in uncomfortable or unnatural positions.

Another advantage of the invention is its dynamic stability while being pushed across a supporting surface.

Other objects, advantages and novel features, and further scope of application of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention, and together with the written description serve to explain the principles of the invention. The drawings are only for the purpose of illustrating a preferred embodiment of the invention and are not to be construed as limiting the invention.

In the drawings.

DESCRIPTION OF THE PREFERRED EMBODIMENT (BEST MODE FOR PRACTICING THE INVENTION)

Figure 1:
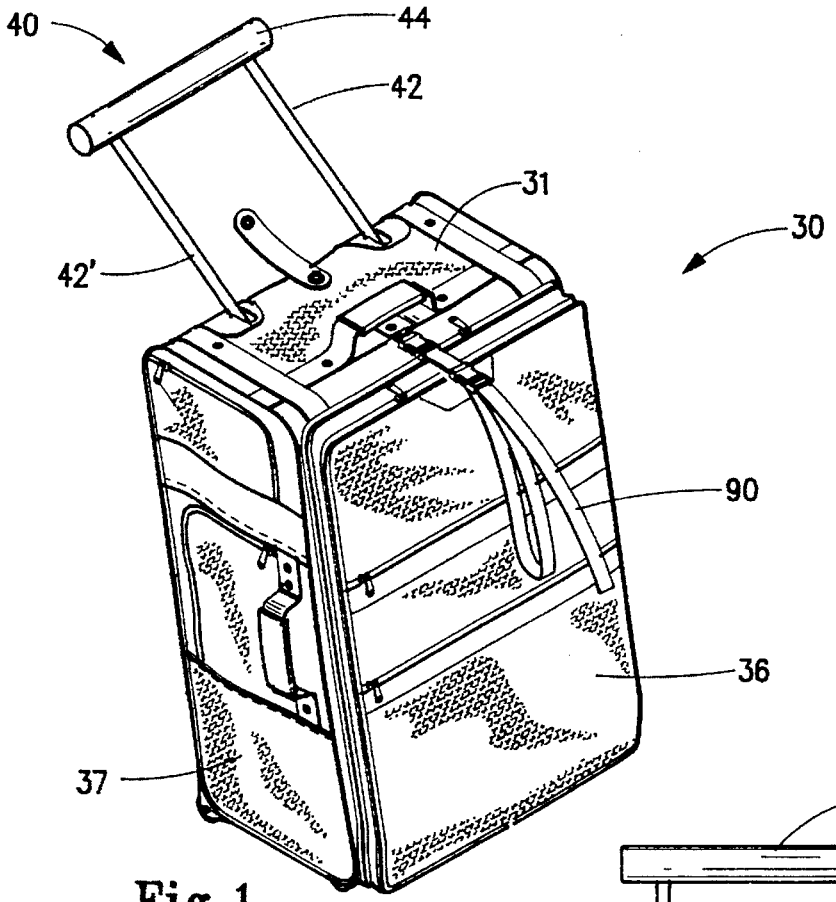
FIG. 1 is a perspective view of the apparatus of the invention, showing the front and a side of the preferred embodiment.
Figure 2:
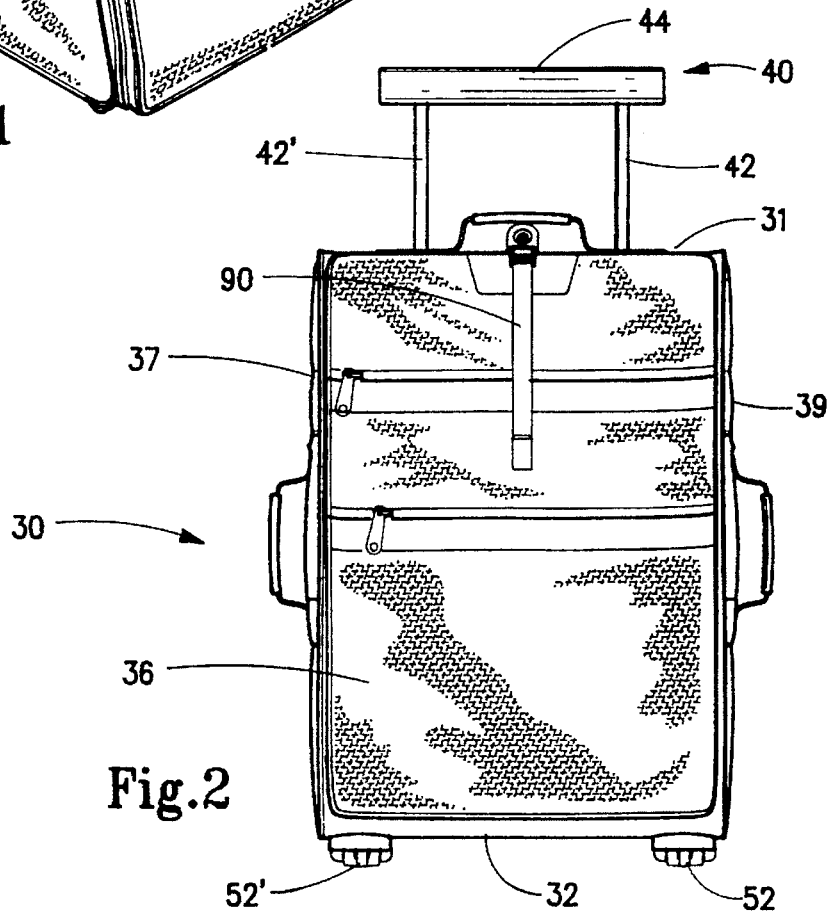
FIG. 2 is a front view of the embodiment of FIG. 1.

The present invention has to do with luggage, particularly "upright" wheeled luggage. The usual item of luggage consists basically of a generally parallelepiped container having six sides and a handle. In this disclosure, "upright" shall mean that, when the wheeled luggage is in standard position for movement across a supporting surface, its major axis is in a mostly vertical orientation (less than about 45° from the vertical). The "major axis" of a luggage container body is an imaginary line segment passing through the body's center of gravity, intersecting both of the two most widely separated opposing sides, and having a length substantially equal to the average distance separating those opposing sides. Thus, the major axis commonly is an axis of symmetry and typically intersects the "top" side and "bottom" side of an upright case near their respective geometric centers. Upright luggage thus is distinguished from wheeled cases in which the major axis remains substantially parallel to the ground, floor, or other supporting surface while the luggage is rolled across a supporting surface. For example, by this definition, conventional "pullman" luggage cases, whether normally rolled on two or four wheels, would not be "upright" luggage.

Upright luggage is not necessarily moved exclusively in an upright position, as it is known in the art to provide handles and/or wheels on more than one side of an item of luggage to allow it to be moved in more than one orientation. The advantages of the present invention are best realized in luggage that is wheeled in an upright position, but the luggage need not be exclusively so transported.

Heretofore in the art of luggage design, wheeled uprights have presented either one of two problems: user discomfort and instability. Most commonly encountered wheeled uprights must be tipped from a vertical position and towed on two wheels—requiring constant support from the user in order to remain upright—posing the problem of strain and discomfort in the user's arm. These conventional upright luggage have a pull handle, which is typically retractable/extendable and configured to be gripped in one hand and used to tow the luggage. The two wheels normally are mounted on an edge of the bottom of the case, and the case is tipped toward the user to be positioned for towing. The user must then constantly support and steady the case in the tilted wheeling position, with a significant portion of the weight of the case borne by the user's rearwardly outstretched arm. The present invention, by locating the center of gravity of the case above a wheel base defined by more than two wheels, eliminates the need for the user to bear weight of the luggage to maintain it in an upright wheeling position.

The present invention also offers the advantage of dynamic stability. A few wheeled uprights known in the art, for example U.S. Pat. No. 4,679,670 to Wickman, have employed more than two wheels to ease the burden upon the user, but have been remarkably unstable and difficult to control while being rolled. The difficulty posed by such systems is that the case is prone to tip over while in rolling motion, especially when one or more wheels encounters an irregularity (e.g., crack, pebble) in the supporting surface. When a wheel encounters a crack or pebble, the surface irregularity acts as a "chock" under the wheel to impede its continued rolling rotation. Deep pile or shag carpets may give rise to a similar undesirable chocking effect. With the rotation of one or more wheels impeded, the moving force imparted to the case by the user creates a turning moment with respect to the chocked wheel axis. Unless the wheel is quickly freed, this turning moment will upset the case by rotating it around the wheel axis, and the user inadvertently upsets the case instead of rolling it. This effect is most pronounced in instances where the user is attempting to push the case rather than tow it. By specially configuring the structure of the luggage with respect to the forces involved, the present invention eliminates or ameliorates the problems posed by inadvertent wheel chocking.

Attention is invited to FIGS. 1–3, 5*a* and 7 which are general depictions of a luggage case according to the present invention. The luggage case has a main body 30 surrounding an interior space 33 in which personal items and the like may be organized and stowed for protection and transport. Main body 30 may be of a hard-side (e.g., molded thermoplastic) or soft-side (e.g., fabric) construction. Ordinarily, body 30 has a top 31, bottom 32, back 34, front 36, and two sides 37, 39, which are substantially planar panels defining and enclosing the interior space 33 and any one of which may bear pockets, carry handles, decorations, welts, piping and the like as shown in the figures. The preferred embodiment of the main body 30 may generally be characterized as a parallelepiped, in that the planes defining the bottom 32 and the top 31 are approximately parallel, the planes containing the sides 37, 39 are generally parallel, and the back 34 and front 36 are generally parallel.

Figure 3:
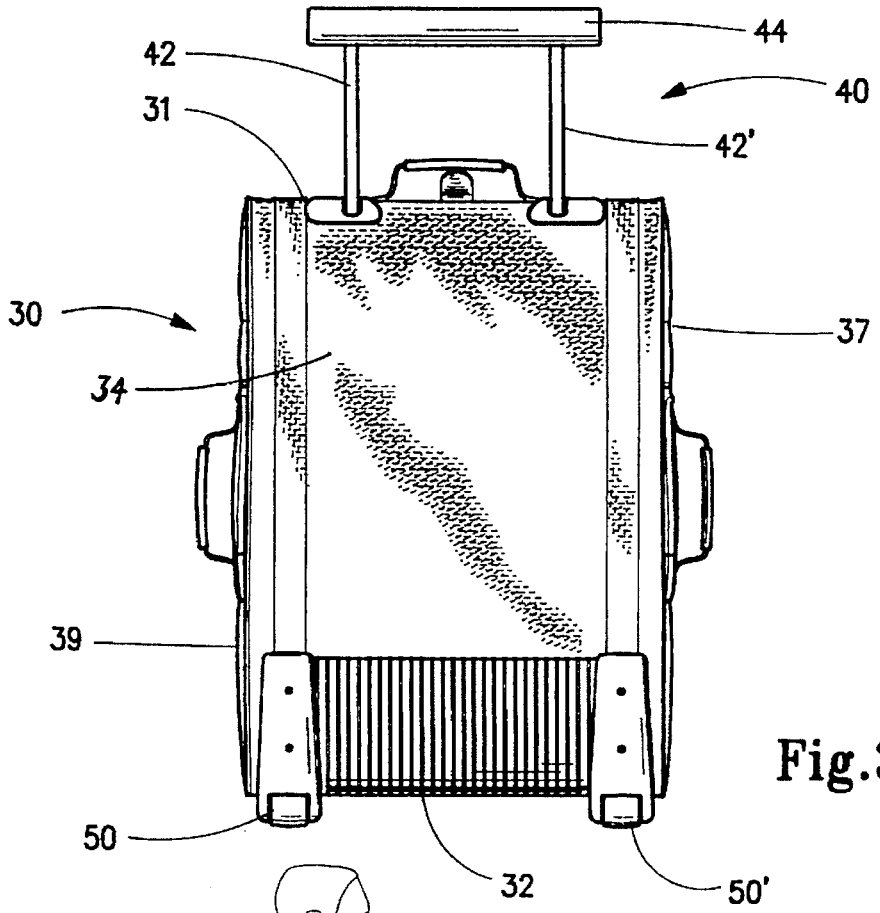
FIG. 3 is a back view of the embodiment of FIG. 1.
Figure 4:
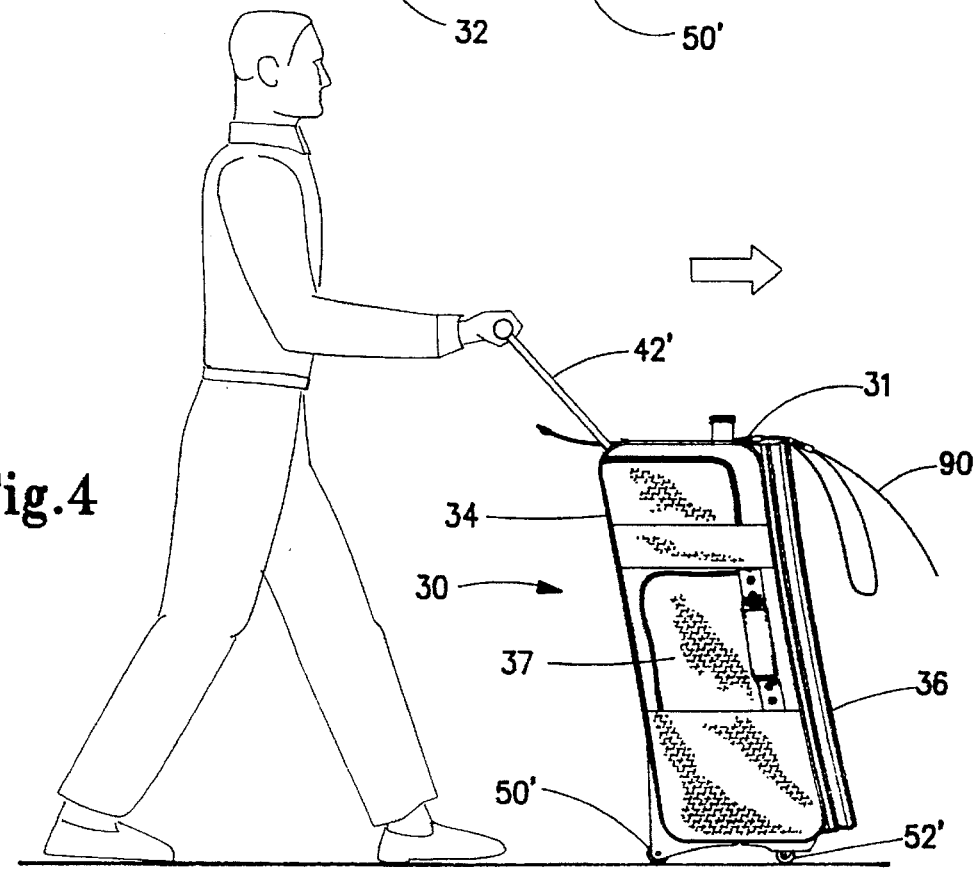
FIG. 4 is a side view of the FIG. 1 embodiment being pushed across a supporting surface by a user.
Figure 5A:
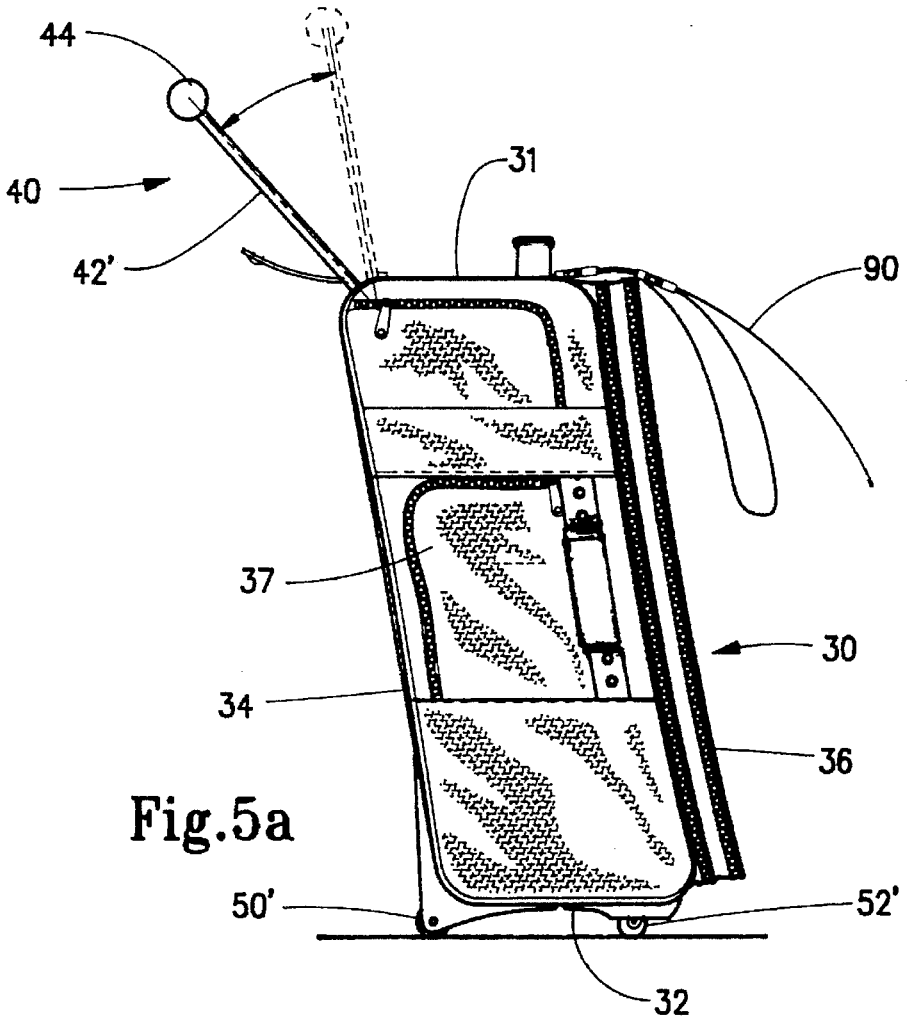
FIG. 5*a* is a side view of the embodiment of FIG. 1.
Figure 8:
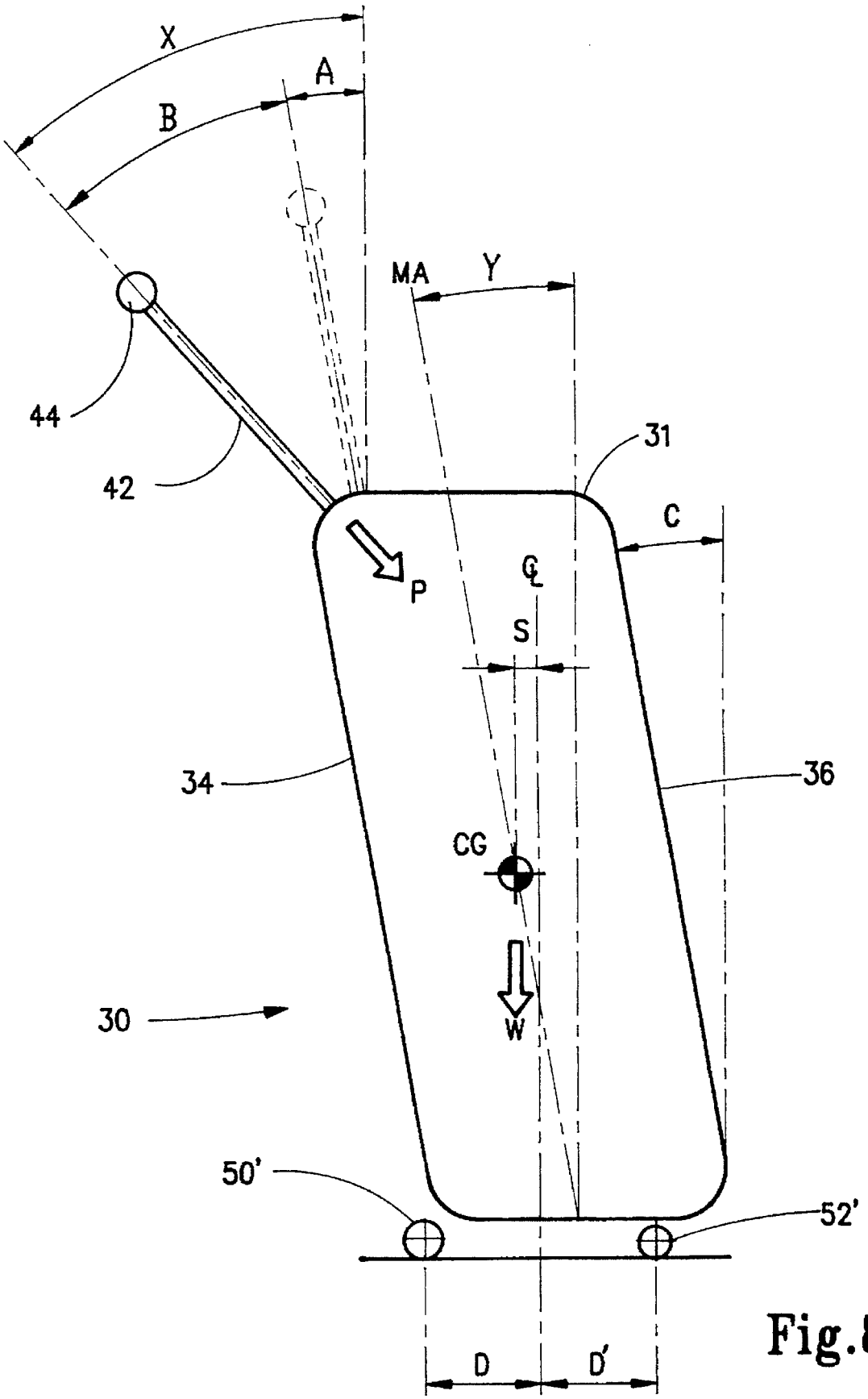
FIG. 8 is a schematic side view of the embodiment of FIG. 1, illustrating certain dimensional aspects of the invention.

In various embodiments this parallelism may not be perfectly preserved throughout the body 30. For example, it may be desirable to provide a bottom 32 that is somewhat larger than the top 31, so that the back 34 and front 36 (and/or the sides 37, 39) converge slightly toward the top 31 of the body 30. Indeed, in one possible embodiment, the sides 37, 39 may mildly converge from bottom 32 toward a somewhat narrower top 31. Such a configuration is aesthetic and desirably lowers the center of gravity of the loaded case, enhancing dynamic stability. Also, in the preferred embodiment illustrated in FIGS. 1–5*a*, the intersections of the back 34 and front 36 with the bottom 32 and top 31 are not defined by right angles. Rather, while the top and bottom panels 31, 32 are both substantially parallel to the supporting surface, the back and front panels 34 and 36 are not perpendicular to the supporting surface, but may be inclined at an angle C (FIG. 8). Consequently, the top 31 intersects both the back 34 and the front 36 at oblique angles, and likewise the intersections of the bottom 32 with the back 34 and front 36 define oblique angles. As best shown in FIGS. 4, 5*a*, and 8, the side view of a preferred embodiment of the main body 30 thus presents a generally rhomboid shape. Referring to FIG. 8, it is noted that the major axis MA of the case will probably, but not necessarily, be generally parallel with either the back 34 or the front 36, or both. The major axis MA intersects top 31 and bottom 32 at oblique angles. This preferred configuration of main body 30 presents certain advantages of utility and stability which will be further described.

Figure 15:
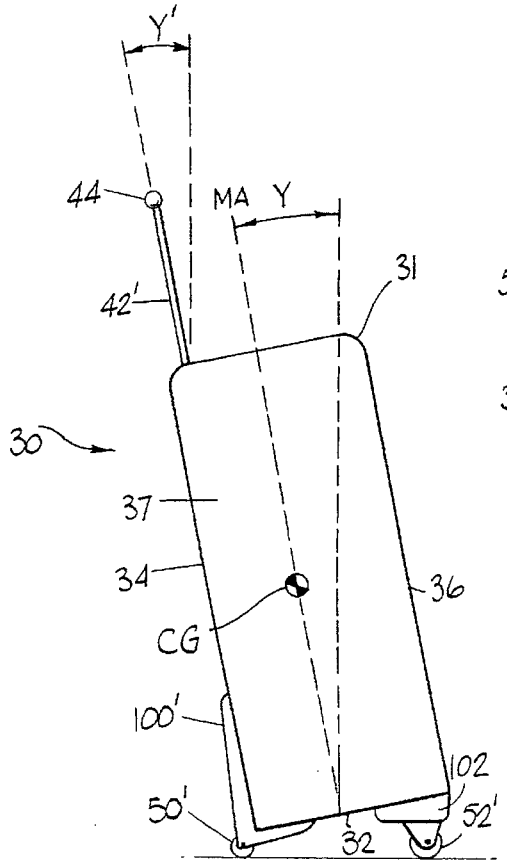
FIG. 15 is a schematic side view of an alternative embodiment of the invention, illustrating certain dimensional aspects thereof.
Figure 20:
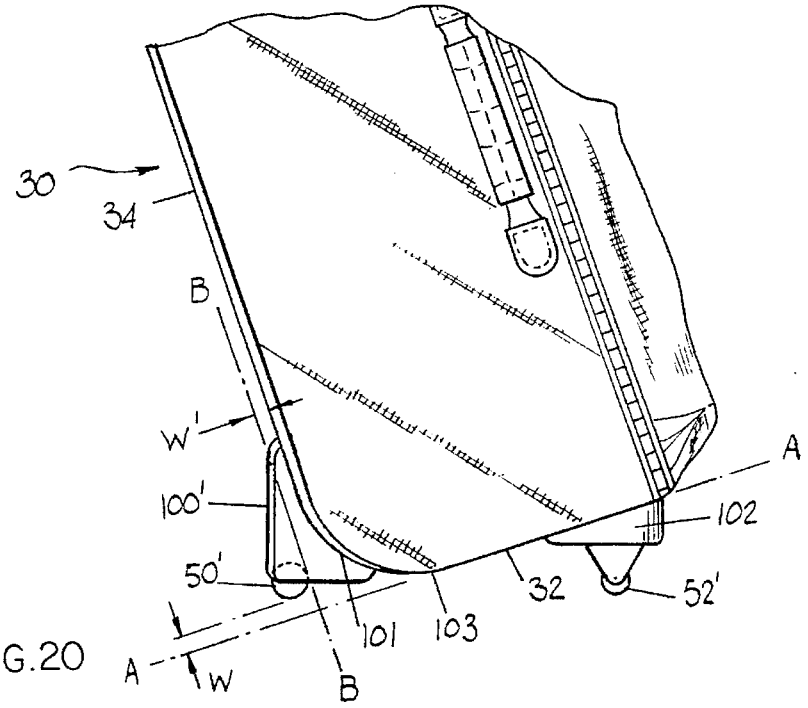
FIG. 20 is an enlarged partial side view of an alternative to the embodiment of FIG. 15.

Desirable alternative embodiments of the invention also may include modifications to one or more sides of the body 30 to enhance appearance, increase packing capacity, or further improve stability. For instance, alternative embodiments may feature a body 30 having a more conventional shape, whereby the side view of the body 30 generally presents a rectangle, as shown in FIG. 15, rather than a rhomboid. In these alternative instances it may be desirable to bifurcate the bottom 32 into two non-coplanar portions intersecting at a very obtuse angle, or even a rounded edge, so that bottom 32 is not a single planar panel, as indicated in FIG. 20.

The apparatus of the invention is provided with at least three, preferably four wheels: two back wheels 50, 50' and two front wheels 52, 52'. In the preferred embodiment, all four wheels are connected primarily to the bottom 32 of the case. Back wheels 50, 50' preferably are fixed-axis wheels, which is to say they rotate in a fixed plane substantially parallel to the direction of travel. Front wheels 52, 52' preferably are "caster" type, whereby the wheels' axes of rotation remain parallel to the supporting surface, but the wheels are pivotable about a vertical axis. Caster wheels are known in the art for easing the task of steering a wheeled case, since the casters pivot to allow the wheels to rotate into the direction of a turn.

Back wheels 50, 50' are fixedly positioned proximate to bottom 32, one wheel situated toward each of the respective sides 37, 39. Ideally, back wheels 50, 50' are situated as close to the sides 37, 39 as practicable to enhance stability. FIGS. 4, 5*a* and 8 show that back wheels 50, 50' are also particularly positioned with respect to the back 34 of the case. In the preferred embodiment, the line defined by the intersection of back 34 with bottom 32 is not collinear with the back wheels' axis of rotation. The axes of back wheels 50, 50' preferably are mildly offset outwardly (toward the user, as shown in FIG. 4) from the imaginary plane containing the back 34 of the case, so that they are a modest distance away from the back 34. The back wheels' 50, 50' axes thus preferably are not exactly on a bottom edge of body 30, although the wheels themselves may be characterized as being connected to the bottom 32 near its back edge. This positioning of back wheels 50, 50', which improves the stability of the case and eases its transport over curbs and stairs, may require that wheels 50, 50' be immovably braced with respect to back 34 as well as connected to bottom 32, as best depicted in FIG. 5*a*, and also in FIG. 15.

Caster type front wheels 52, 52' are mounted on bottom 32 near the intersection of the bottom 32 with the front 36. Front wheels 52, 52' should be attached reasonably close to the front 36 of the body, but aesthetics and the need to protect the casters 52, 52' suggest that they be placed somewhat inwardly (toward the user) of the front 36 of the case, as shown in FIG. 5*a*. Such placement fully underneath body 30 does not detract appreciably from the utility of the invention.

Alternative embodiments of the invention may reverse the respective employment of caster-type wheels versus fixed-axis wheels. It may be desirable to use caster wheels for back wheels 50, 50' and fixed-axis wheels in the positions of front wheels 52, 52'. Reversing the style of wheels in such a manner may also be accompanied by deliberate adjustments to the length of the wheel base dimension D plus D' (FIG. 8).

An alternative embodiment of the invention may have only three wheels. In such an embodiment, there is only one front wheel, which is a caster type wheel. The lone front wheel is fixed to the bottom 32 of the case proximate to the front 36 and equidistantly from the sides 37, 39.

It is contemplated that the apparatus of the invention will be pushed upon four wheels by the user, as suggested by the direction of travel arrow in FIG. 4. However, it will be appreciated that the apparatus may also be pulled or towed behind the user. When towed, the body 30 may wheel along on all four wheels, or may be further tipped toward the user and wheeled only upon back wheels 50, 50', if desired.

The invention includes a handle assembly 40 connected to the main body 30 in the general vicinity of the edge defined by the intersection of top 31 and back 34, as shown in FIGS. 1–3 and 5*a*. Components of handle assembly 40 include one or more handle rods 42, 42' extending from the body 30 and to which is attached handle grip 44. In the preferred embodiment, handle rods 42, 42' are a pair of straight, parallel spaced apart steel tubes. Alternatively, a single centrally positioned rod or elongated plate can be employed, and the apparatus modified accordingly, without departing from the scope of the invention. Handle grip 44 extends beyond the handle rods 42, 42' toward sides 37, 39, and is configured to be comfortably grasped by the user in one or both hands, to permit the user to push or pull the body 30 upon wheels 50, 50', 52, 52' across the supporting surface.

A central aspect of the apparatus of the invention is its configuration and orientation with respect to gravity. FIGS. 5*a* and 8 show that the major axis MA of main body 30 is tilted with respect to the supporting surface. For purposes of description, the supporting surface is assumed always to be substantially horizontal, but this assumption shall not limit the scope of our invention. Main body 30 is canted toward the user, that is, top 31 is closer to the user than bottom 32. Consequently, when the apparatus is pushed across a supporting surface, as shown in FIG. 4, main body 30 leans away from the direction of travel. The amount of tilt is the size of angle Y, shown in FIG. 8. Angle Y is the angle included between the intersection of major axis MA of main body 30 and a line perpendicular to the supporting surface, measured in a plane parallel to the direction of travel.

Further reference is made to FIG. 8, which is a schematic representation of the side view of the main body 30. Shown are graphic depictions (not necessarily scaled to depict relative magnitudes) of force vectors P and W. Vector P represents the force upon the main body 30 exerted by the user when she pushes on handle grip 44. The magnitude and direction of the pushing force represented by vector P are variables that differ depending on the factors of use, including surface condition of the supporting surface, stature of the user, as well as the exact geometry of the luggage body itself. Generally, pushing force P will have a major component in the direction of intended rolling travel, or from left to right and parallel to the supporting surface shown in FIG. 8. It is likely pushing force P will also have a substantial but relatively minor component in a vertically downward direction due to the natural tendency of the user to rest hands on the handle grip 44, and to unconsciously push down on grip 44 to enhance steering control of the case. Force vector P is shown to be in a direction substantially parallel to handle rods 42, 42'. The magnitude of the force depends upon how hard the user pushes upon handle grip 44.

Vector W represents the gross weight of the luggage case. The magnitude of vector W depends upon the weight of the luggage case and upon how full the main body 30 is packed and the weight of the contents. For purposes of this disclosure, vector W is deemed to act in a line vertical to the supporting surface and passing through the center of gravity CG of main body 30. Known principles of solid geometry teach that the location in space of center of gravity CG of body 30 is a function primarily of the three-dimensional shape of the body. In this disclosure, the center of gravity CG of a loaded case is acceptably assumed to be a fixed point locatable by geometric analysis, although its location actually may vary somewhat depending on the contents of the main body 30 and how they are loaded. Accordingly, the location of center of gravity CG may be predetermined and fixed by the designed shape of the body 30 of the case.

Vectors P and W may be resolved into a single vector characterizing the combined effects, at any particular time, of the weight of the packed case and the pushing (or pulling) effort of the user; this resultant vector, and the corresponding reactive forces acting through the wheels 50, 50', 52, 52' upon the main body 30, determine whether the entire luggage case is in dynamic equilibrium. The case is deemed to be in dynamic equilibrium when it is rolling on four wheels in a direction substantially parallel to the supporting surface, but is not rotating about any axis parallel to the supporting surface. Rotation about any axis parallel to the supporting surface is indicative of dynamic instability—tipping, a problem frequently encountered with known devices, as previously explained.

Dynamic stability of the case is improved when the resultant of vectors P and W is directed along an imaginary line that passes through the bottom 32 at a point between the axes of the back wheels 50, 50' and the axes of the front wheels 52, 52'. (Additionally, if a vertical line passing through the center of gravity of a loaded case does not also pass through the bottom 32, the case will probably not have static stability, i.e., when standing still it will fall over under its own weight.)

The size of angle Y, among other things, establishes the front to back location of the center of gravity CG with respect to bottom 32. Moreover, in simpler alternative embodiments of the invention wherein the extended pull handle rods 42, 42' in use are substantially parallel to the major axis of body 30, the size of angle Y also fixes the point of application of the pushing force vector P.

We have determined that there is a range of values for angle Y which optimize the overall stability of our luggage case while preserving an aesthetic appearance. As previously mentioned, the location of the center of gravity CG is one of two major factors (the other being the pushing vector P) which influence the stability of the case, particularly under dynamic conditions of wheel chocking. The location of the center of gravity, and to a lesser extent the horizontal and vertical components of pushing vector P, are affected by the size of Y. In all embodiments of the invention, angle Y preferably is in the range of from about 6° to about 25°. At angles of Y in excess of about 25°, body 30 expresses symptoms of static instability, i.e., the body 30 tends to fall backward (in the direction of the tilt) under its own weight, especially when loaded. More preferable, for reasons of stability, is an angle Y in the range of from about 9° to about 12°. In our most preferred embodiment, considerations of stability (particularly dynamic stability), and aesthetics direct that angle Y is about 10°.

Figure 5B:
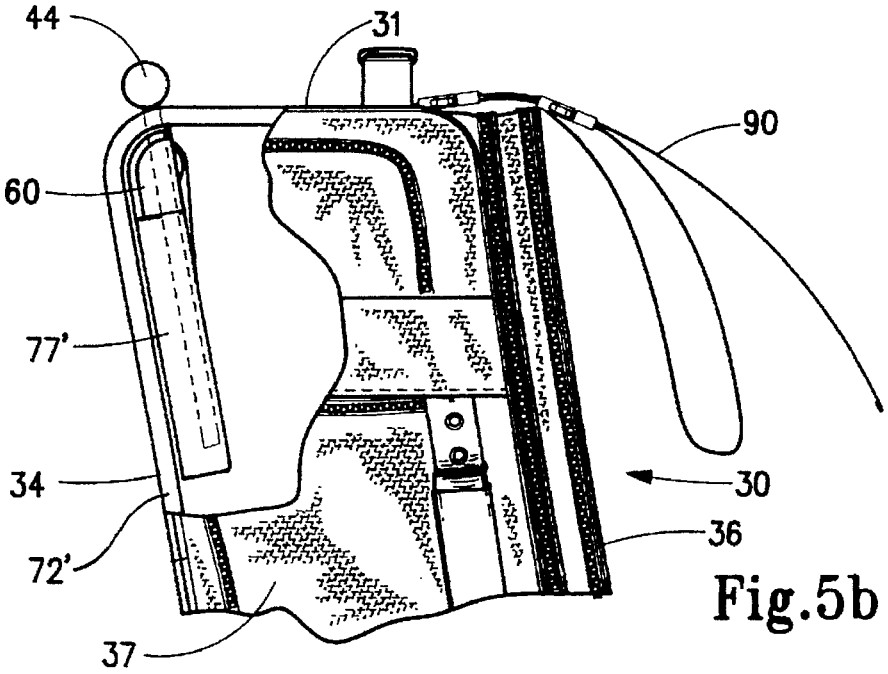
FIG. 5*b* is a an enlarged partial side view of the embodiment of FIG. 1, with a portion broken away to reveal certain components of the pull handle assembly.

Handle rods 42, 42' and handle grip 44 may be fully extended from the case as shown in FIGS. 1–5*a*, or may be retracted into main body 30 as shown in FIG. 5*b*. In the fully retracted position, handle rods 42, 42' are substantially completely within the confines of body 30 and handle grip 44 is adjacent or flush to the exterior (top 31 and/or back 34) of main body 30. With handle rods 42, 42' retracted, the case is configured for stowage in the trunk of a car, checking at airport luggage clerk, and the like. The handle rods 42, 42' and grip 44 are fully extended to the position of FIG. 4 to push or pull the case.

Another aspect of the invention is the angle at which the handle rods 42, 42' protrude from body 30 when in a position to be used to move the case. Reference is made to FIGS. 5*a* and 8. Handle assembly 40 is connected to an upper portion of main body 30 by means elsewhere described. It is noted that, in the preferred embodiment, handle rods 42, 42' (when in use to move the case) define an angle X with respect to the vertical. Referring to FIG. 8, angle X is included between a line extending from the grip 44 to the point where rods 42, 42' connect to body 30 and a line perpendicular to the supporting surface, in a plane parallel to the direction of travel. Since in the preferred embodiment grip 44 is in the same plane as rods 42, 42', angle X may simply be measured between the rods and a vertical line in a plane parallel to the direction of travel.

The length of the handle rods 42, 42' and the magnitude of angle X determine where the user applies the pushing force to the handle 44, which in turn has a dominant affect on the direction of vector P (and thus its horizontal and vertical components). Vector P in turn affects the size of an overturning moment which may cause body 30 to rotate and upset when one or more wheels are chocked. Accordingly, the size of angle X must be optimized within the constraints imposed by the need for dynamic equilibrium, as well as the need to have a handle that protrudes towards the user to permit adequate stride room and at a height easily gripped, and at an aesthetically pleasing position.

When angle Y, the tilt of the major axis of the body 30, is in the range of from about 6° to about 25°, angle X is in the range from about 10° to about 48°. (Larger handle angles X suggest the use of proportionately smaller angles Y, and visa-versa.) Dynamic stability falls off dramatically for angles X in excess of about 48°. We have found that angles X of less than about 10° also are undesirable, from standpoints of aesthetics and user comfort, as well as stability.

We have determined that a combination of respective ranges and specific sizes of angles X and Y optimizes stability, appearance, and user comfort. Preferably, the tilt of the body 30, angle Y, is from about 9° to about 12°, and the corresponding respective angle of the handle, angle X, is from about 40° to about 45°, with the handle angle X increasing as the tilt angle Y of the body is decreased. The most preferred embodiment of the invention, which maximizes stability without sacrificing user comfort or ease of use, has an angle Y of about 10° in combination with an angle X of about 42°. With body 30 and handle rods 42, 42' respectively so positioned, the invention is ideally configured for use.

Stability, as well as aesthetics, is also a function of the relative proportions of the dimensions of main body 30. The body 30 has three principal dimensions: the height (mean distance between top 31 and bottom 32 measured perpendicular to the supporting surface); the depth (mean distance between front 36 and back 34, measured along a line parallel to the supporting surface and generally in the direction of travel) and the width (mean distance separating the sides 37, 39, also measured parallel to the supporting surface but generally perpendicular to the direction of travel). A problem posed by wheeled upright luggage cases is that while factors unrelated to stability (e.g., aesthetics, consumer preference, and ease of packing) strictly limit the feasible depth of the luggage body, dynamic stability is enhanced by increasing the depth to permit an increased longitudinal wheelbase (D+D' in FIG. 8). It has been proposed in the past to solve this dilemma by placing one pair of wheels on a shallow case, but lengthening the wheelbase by placing the second pair of wheels outboard to the case, for example on a swing-out auxiliary frame or rack extending from the case adjacent to and parallel to the supporting surface.

The present invention, by tilting the major axis of the body 30 of the case in a range of preferred angles, permits the depth of the body to fall within acceptable limits while also permitting all the wheels to remain attached to the body. Complicated and unsightly extendible or pivotable auxiliary wheel frames and the like are unnecessary. As shown in FIG. 8, tilting the major axis MA of the body 30 of the case to any of the preferred angles shifts the center of gravity CG toward the back wheels 50, 50' some minor distance S from the centerline of the wheelbase. The centerline of the wheelbase is that point where the distances D and D' are equal. Tilting the body 30 to cause the weight vector W to act downwardly between the wheelbase centerline and the back wheels 50, 50' permits the body 30 to be attractive and functional.

The depth of the body 30 thus remains modestly proportioned relative to the height and to the width, without sacrificing stability. In the preferred embodiment, for a given depth dimension, the height of body 30 is from about 220% to about 230% of the depth, while the width is from about 170% to about 180% of the depth. By employing these relative proportions, an acceptably limited depth (e.g., approximately 28 cm) nevertheless permits an ample packing volume for body 30, while the inventive configuration preserves functional stability.

It may be noted that the preferred embodiment, presenting a side view with a rhomboid shape (front 36 and back 34 tilted and generally parallel to the major axis MA, top 31 and bottom 32 both parallel to the supporting surface) poses the added benefit of lowering the overall center of gravity of the body compared to a conventionally shaped case presenting a rectangular side view (top 31 and bottom 32 intersecting front 36 and back 34 at right angles). Compared to a rectangular embodiment, the rhomboid-shaped embodiment of body 30 "hugs" the ground by effectively shifting container volume from the uppermost region of the case to a lowermost portion of the case near the supporting surface.

Handle rods 42, 42' and grip 44 may be pivotable between two principal positions: an "up" or "storage" position depicted in phantom by the dashed lines of FIGS. 5*a* and 8, and a "down" or "ready" position shown by the solid lines in those figures. Handle rods 42, 42' and grip 44 may be controllably pivoted back and forth through an angle B (FIG. 8) to either of the extreme radial positions shown in FIG. 5*a*. Rods 42, 42' and grip 44 are supported and locked in either of these two radial positions by detent mechanisms to be further described. When handle rods 42, 42' and grip 44 are in the ready position, depicted by the solid lines in FIG. 5*a*, they are in position to be gripped by the user and employed to push or pull main body 30. Firm upward pressure exerted on grip 44 disengages a detent mechanism, allowing rods 42, 42' to swing radially (see directional arrow of FIG. 5*a*) to the storage position, where a detent engages to releasably lock the handle assembly 40 against further rotational movement.

In the storage position, handle rods 42, 42' extend from body 30 substantially in the same imaginary plane (or a close parallel) as contains back 34. FIG. 8 shows that even when in the up position, handle rods 42, 42' define an angle A from the vertical. In a simple embodiment of the invention, angle A is substantially equal to angle C, since the planes containing front 34 and back 36, respectively, preferably are substantially parallel. From this up or storage position, handle rods 42, 42' may be collapsed into main body 30 for complete storage, as shown in FIG. 5*b*.

FIGS. 5*b*, 6, 9, 10 and 11 collectively set forth the details of handle assembly 40 which enable handle rods 42, 42' to pivot with respect to body 30 and also to retract into and extend from body 30. Handle assembly 40 includes a substantially rigid mounting member 60, a pair of ratchet blocks 62, 62', a pair of rotator collars 64, 64' (one in confronting relation with each of ratchet blocks 62, 62'), and a pair of backing plates 78, 78'. Ratchet blocks 62, 62' and rotator collars 64, 64' may be fashioned from durable, fracture resistant thermoplastic.

Figure 9:
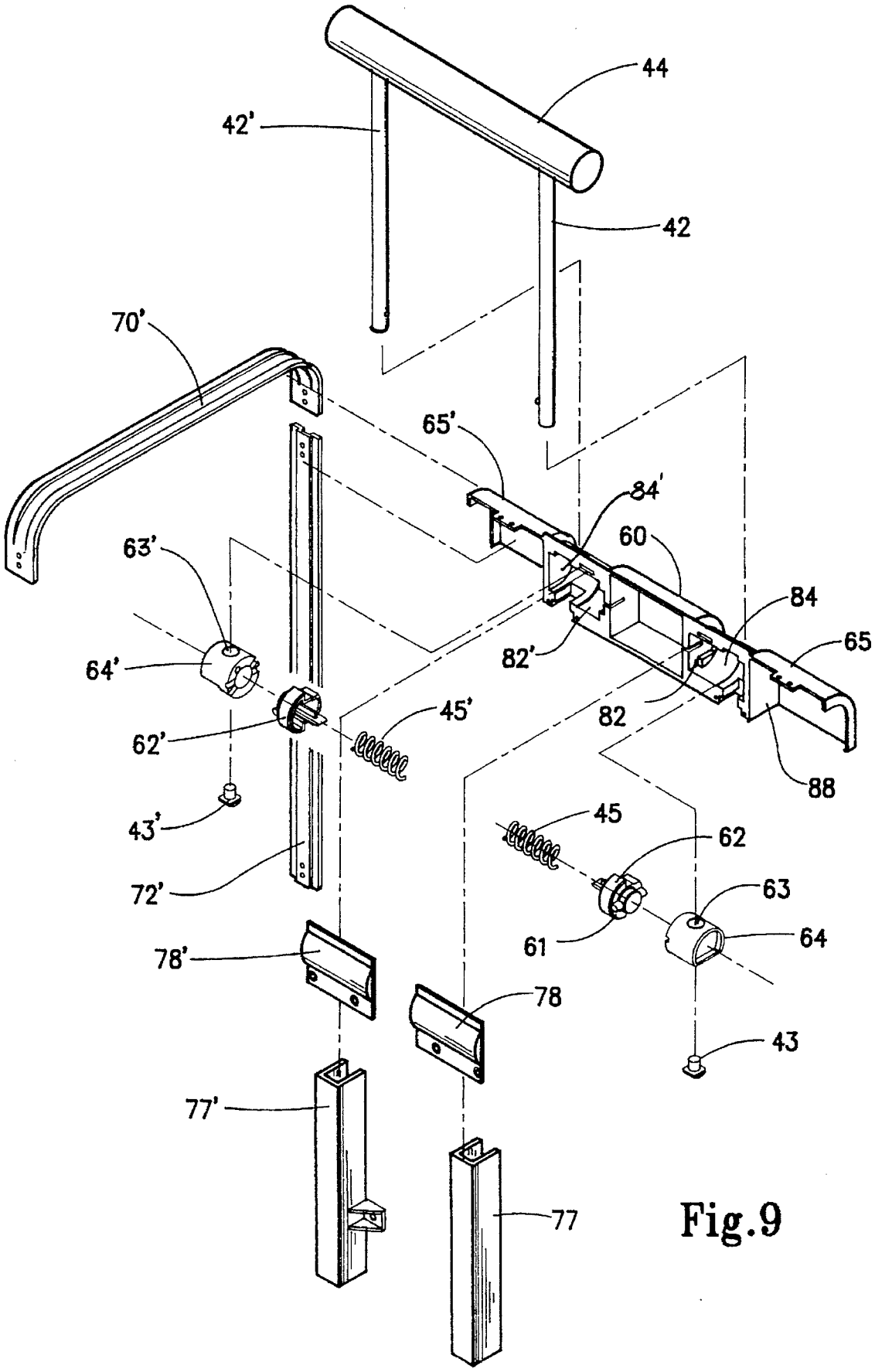
FIG. 9 is an exploded perspective view of the pull handle assembly of the embodiment of FIG. 1.

Mounting member 60 preferably is a single element, or may be comprised of several components joined together. Mounting member 60 may be fashioned from injection molded plastic, so that it may be specially shaped to surround and hold the various other elements of handle assembly 40. As shown in FIG. 9, mounting member 60 has a specialized shape, but is bilaterally symmetrical so that description of one side serves to describe the entirety. Similarly, as indicated in FIG. 9, the other components of the handle assembly occur in analogous pairs, e.g., handle rod stop caps 43, 43', springs 45, 45', and rod sleeves 77, 77', where description of one member of the pair describes both members.

Figure 6:
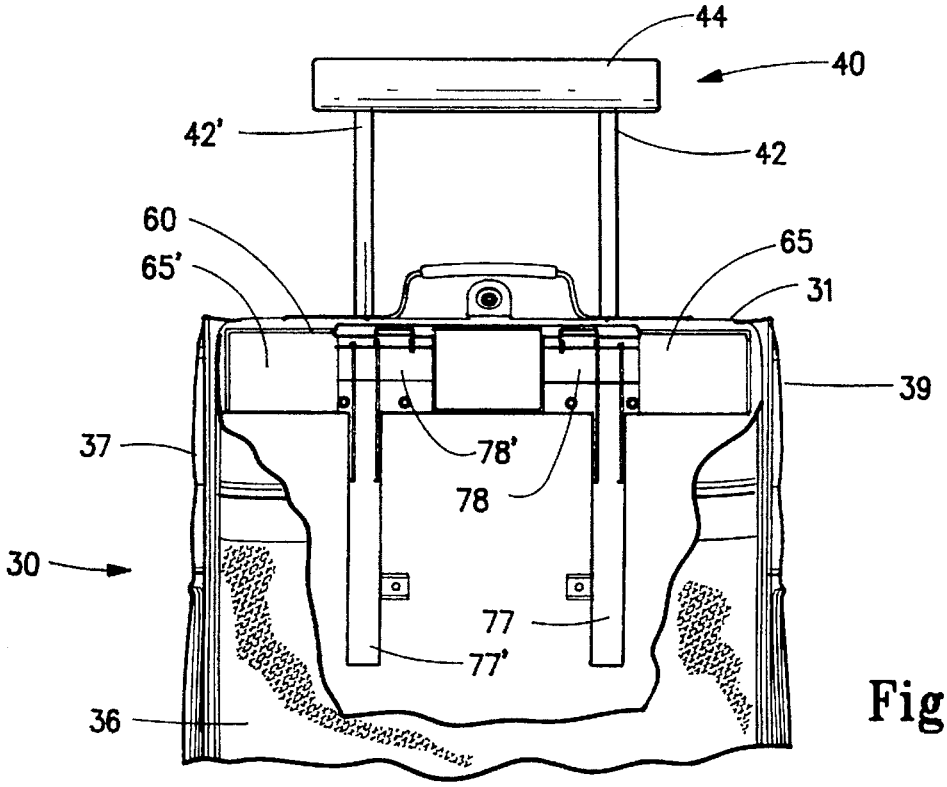
FIG. 6 is an enlarged partial front view of the embodiment of FIG. 1, with a portion broken away to reveal certain components of the pull handle assembly.
Figure 10:
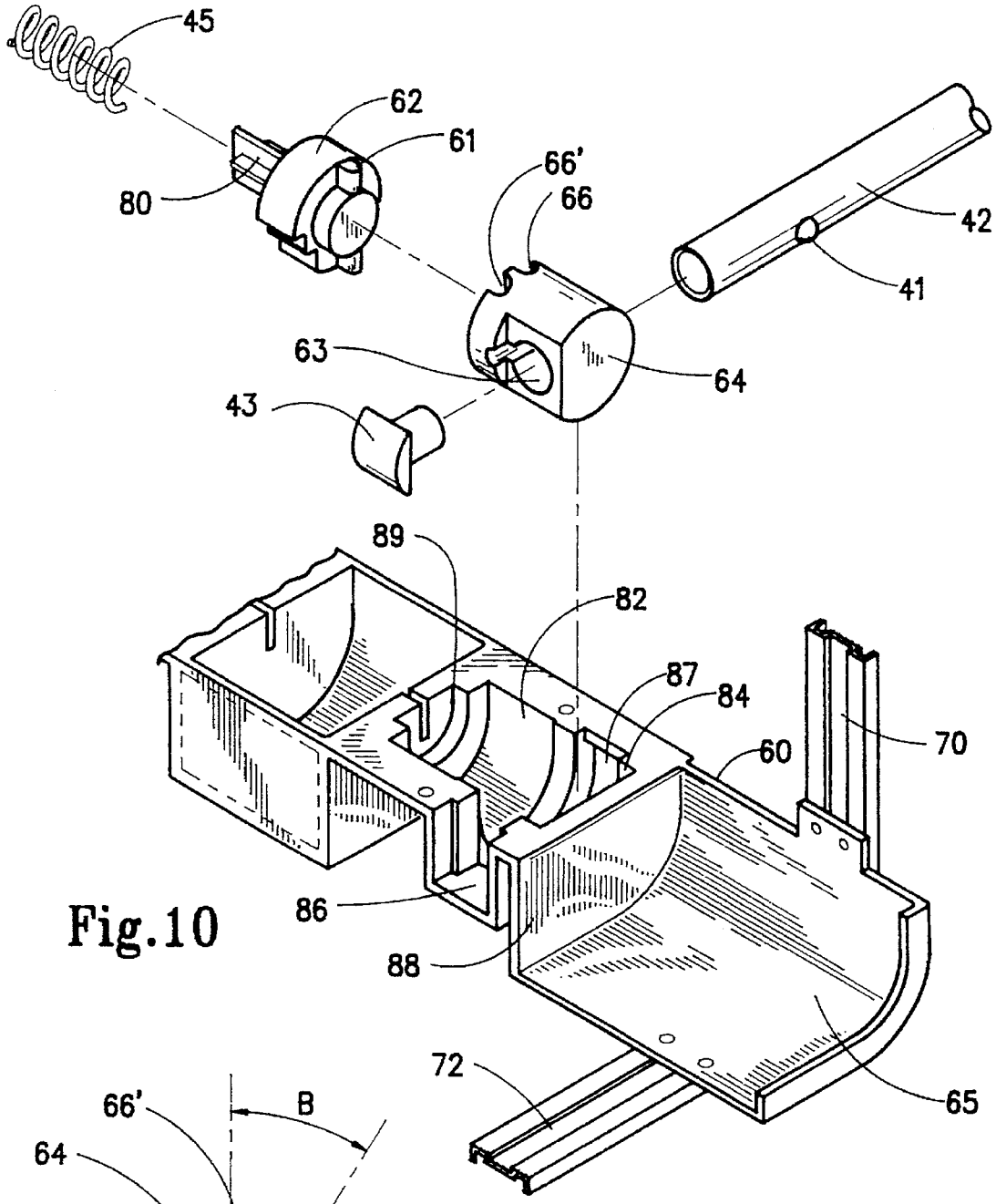
FIG. 10 is an enlarged view of a portion of the FIG. 9 embodiment, rotated approximately ninety degrees to reveal certain details thereof.

The respective ends of mounting member 60 consist of generally arcuate-shaped wing flanges 65, 65'. Flanges 65, 65' are affixed to correspondingly shaped portions of top frame elements 70, 70' and back frame elements 72, 72' of the apparatus, as with screws or rivets, as shown in FIGS. 5*b*, 9 and 10. Frame elements 70, 72 are principal structural components of the body 30 of a soft-sided embodiment of the case. While the figures depict frame elements 70, 72 as separate components, each side frame (in the preferred embodiment there are two) may be an integrally extruded rail, bent at three or four places and joined end-to-end to define the appropriate rhomboid or rectangular configuration for supporting a side 37 or 39. Alternatively, mounting member 60 may be molded into or attached to a shell of a hard-sided case. Thus mounting member 60 functions as the main means for structurally connecting the handle assembly 40 to the body 30. Mounting member 60 is attached to frame or shell at or near the intersection of top 31 with back 34, as shown in FIGS. 5*b* and 6, so that the handle assembly is disposed proximate to the user as illustrated in FIG. 4.

FIG. 9 depicts the overall positional relationships of the various components of a complete handle assembly. Mounting member 60 is fastened to the frame elements 70, 72 (only one side set shown) of body 60. Rotator collars 64, 64' are placed in confronting relation with ratchet blocks 62, 62', and springs 45, 45' are each placed axially around a respective spring shaft 80 (FIG. 10) on each of ratchet blocks 62, 62'. The blocks 62, 62', collars 64, 64', and springs 45, 45' are disposed within cylindrical cavities in mounting member 60. Handle rods 42, 42' are each passed through a separate corresponding rod aperture 87 (FIG. 10) in mounting member 60 and then are also inserted completely through rod tunnels 63, 63' in rotator collars 64, 64' (the tunnels 63, 63' each being generally aligned with a separate respective rod aperture 87). Each of distal ends of rods 42, 42' which emerges from the tunnels 63, 63' is fitted with a stop cap 43, 43', as shown in FIG. 9. Backing plates 78, 78' are then secured to mounting member 60 to hold springs 45, 45', rotator collars 64, 64' and ratchet blocks 62, 62' in place within mounting member 60. Rod sleeves 77, 77' are attached to the backing plates 78, 78' so as to extend downwardly therefrom. Mounting member 60 is shaped to retain, support, and guide the operational elements of the pivotable handle assembly 40. FIG. 10 shows one side of mounting member 60, the other side being a substantially the same (but reversed as to relative positions). Each side of mounting member 60 is shaped to provide two adjacent, specialized, compartments, block cylinder 82 and collar cylinder 84. Block cylinder 82 and collar cylinder 84 are semicylindrical cavities adapted to receive and cradle ratchet block 62 and rotator collar 64, respectively. Cylinders 82, 84 correspond closely in size and shape with their respective block 62 and collar 64 components.

As shown in FIG. 10, mounting member 60 has a handle rod aperture Handle rod aperture 87 is located in mounting member 60 so that rod aperture will be located at or near the intersection of top 31 and back 34 of body 30. Handle rods 42, 42' thus extend upward and outward from the body 30 toward the user, as shown in FIG. 4. Rod aperture 87 has a substantially larger cross section than the cross sectional size of rod 42, so that rod 42 has room to pivot in a plane parallel to the direction of travel, as further described below.

In the assembled and functional handle assembly 40, the generally cylindrical rotator collar 64 is disposed within collar cylinder 84 so as to be rotatable about its own axis, which rotation permits the pivoting motion of an associated handle rod 42. The length of collar cylinder 84 constrains rotator collar 64 against any significant longitudinal shifting movement, as rotator collar 64 is held between the ratchet block 62 and collar wall 88 (an integral part of mounting member 60). Ratchet block 62 is disposed into block cylinder 82, which is substantially coaxial with collar cylinder 84 but may have a smaller radius. Ratchet block 62 has one or more ridges or keys that engage with corresponding grooves or keyways in block cylinder 82, which engagement prohibits ratchet block from axially rotating. However, the length of block cylinder 82 exceeds somewhat the length of ratchet block 62, so that ratchet block is slidably movable to and fro between rotator collar 64 and the ratchet block wall 89 portion of the mounting member 60. Thus, ratchet block 62 has a degree of freedom to translate longitudinally, but cannot slidably rotate, within block cylinder 82. Conversely, rotator collar 64 can slidably rotate within collar cylinder 84, but cannot significantly move longitudinally. Both the rotator collar 64 and the ratchet block 62 are held in place and enclosed within their corresponding cylinders 84, 82 by backing plates 78, 78', which are secured to the mounting member 60.

Compression spring 45 is disposed around spring shaft 80 on ratchet block 62. Spring 45 is compressed into a disposition between ratchet block wall 89 and the body of the ratchet block 62, so as to constantly bias the ratchet block 62 against the rotator collar 64, and rotator collar 64 in turn is pressed against collar wall 88. Rotator collar 64 is slidably rotatable with respect to ratchet block 62.

Rotator collars 64, 64' are completely penetrated along a respective diameter by tunnels 63, 63' in and through which corresponding handle rods 42, 42' are slidably disposed. The reciprocation of handle rods 42, 42' within tunnels 63, 63' permits the retraction of the rods 42, 42' into the body 30. A distal end of each rod 42 protrudes from within rotator collar 64; a stop cap 43 is secured to the distal end of the rod 42 to prevent rod 42 from being withdrawn completely out of tunnel 63.

Figure 11:
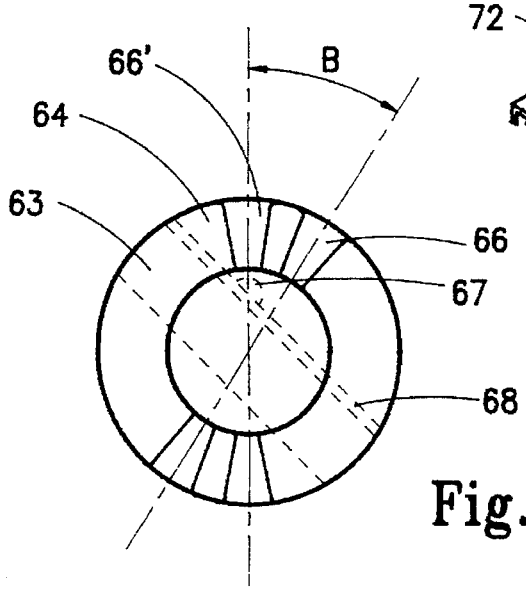
FIG. 11 is an enlarged side view of a component of the FIG. 10 embodiment.

FIGS. 9–11 illustrate that the interior end of each rotator collar 64, 64' is diametrically transected by a pair of radially offset cam grooves 66, 66'. Cam grooves 66, 66' correspond generally to a cam ridge 61 which protrudes diametrically across the exterior end of ratchet block 62. Exterior end of ratchet block 62 and interior end of rotator collar 64 are in constant contact due to the biasing force of spring 45. Cam ridge 61 conforms with and is engageable into either of cam grooves 66 or 66'. The interaction between rotator collar 64 and ratchet block 62, and the releasable locking occasioned by the engagement of cam ridge 61 with either of cam grooves 66, 66', permits the handle assembly to pivot through angle B and releasably lock in either of the positions depicted in FIG. 5*a*.

As noted in FIG. 11, cam grooves 66, 66' are offset radially from each other by an angle B, which equals the angle B of FIG. 8. When cam ridge 61 is engaged into one of the cam grooves, e.g., cam groove 66, handle rod 42 is held in one of the principal positions of FIG. 5*a*, e.g. the upper storage position depicted by the dashed lines. Spring 45 pushes away from collar wall 89 to hold ratchet block 62 against rotator collar 64 and cam ridge 61 in cam groove 66. Because ratchet block is not free to rotate around its own axis, the rotator collar is also releasably held against rotation, and handle rod 42 is maintained in the storage position—from which position it can be slid into the main body 30 for storage.

The handle assembly 40 permits the user to pivot handle rod 42 from the storage position into the ready position shown in solid lines in FIG. 5*a*. The user simply presses abruptly downward on grip 44, which pushing action overrides the interlock between cam ridge 61 and cam groove 66. The user continues to push downward on the grip 44 and pivots the handle rod 42 through the angle B shown on FIG. 5*a*. This movement of the handle rod 42 rotates the rotator collar 64 through the same angle B. Rotator collar 64 rotates about its own axis, but since ratchet block 62 is interlocked with block cylinder 82 to prevent rotation, rotator collar 64 rotates with respect to ratchet block 62. This relative rotation induces cam ridge 61 out of cam groove 66, pushing ratchet block 62 against the compressive force of spring 45 and slightly toward block wall 82, as cam ridge "rides" up the side of and out of groove 66. Continued pivoting of handle rod 42, and resulting rotation of the rotator collar 64, aligns cam ridge 61 with the second cam groove 66'. The biasing force provided by spring 45 shifts ratchet block 62 a slight distance back toward rotator collar 64, and causes cam ridge 61 to engage into the second cam groove 66', again releasably interlocking the rotator collar 64 and ratchet block 62. In this latter interlocked position, the rotator collar 64 maintains the handle rod 42 in the lower position shown in FIG. 5*a*, and the handle assembly 40 is ready for use to push or pull the luggage case.

Accordingly, handle rod 42 may alternatively be pivoted back and forth between the two positions shown in FIG. 5*a*, as the rotator collar 64 rotates within collar cylinder 84 a corresponding angle. The ratchet block 62 reciprocates axially to and fro to permit cam ridge 61 alternatively to snap into either of cam grooves 66 or 66' to hold the handle rod 42 in either of its respective principal positions.

As mentioned, rods 42, 42' may be retracted into body 30 to the position shown in FIG. 5*b*. The retraction of rods 42, 42' may only occur from the upper storage position of rods 42, 42' shown in phantom by the dashed lines of FIG. 5*a*, i.e., when the rods 42, 42' are at a definite angle A from the vertical (FIG. 8). To collapse the rods 42, 42' and grip 44, the user merely pushes downward on grip 44 in a direction generally parallel with rods 42, 42'. In other positions of handle rods 42, 42', when the handle rods define an angle greater than A but less than or equal to X, forces upon grip 44 are translated into movement of the wheeled luggage across the supporting surface. Such selectivity is the result of the interaction between stop caps 43, 43' and the backing plates 78, 78'.

Combined reference is made to FIGS. 10 and 11. Each rod 42 is provided with a depressible spring detent 41 which protrudes from rod 42 a short distance from its distal end. A mild groove 68 corresponding to detent 41 runs longitudinally along the inside surface of tunnel 63 (FIG. 11), so that as rod 42 moves up and down in tunnel 63, the detent button 41 slides within groove 68 to prevent the rod 42 from rotating about its axis within the tunnel 63. Within the tunnel 63, at a predetermined location along the groove 68, is a concave depression 67 into which detent button 41 may pop. Depression 67 is so located within rotator collar 64 so as to provide an audible clicking sound when the rod 42 is fully extended from the body 30 and the stop cap 43 is drawn up against rotator collar 64. The releasable engagement of detent 41 with depression 67 thus informs the user that the rods are extended to their ready position. The engagement of detent 41 with depression 67 also prevents rod 42 from sliding under its own weight through tunnel 63 and dropping back into body 30.

A distal end of rod 42 emerges from tunnel 63 in rotator collar 64. As illustrated in FIG. 9, upon the distal end of each of rod 42, 42' is securely affixed one of the pair of stop caps 43, 43'. Stop caps function to prevent the rods 42, 42' from being pulled completely out of rotator collars 64, 64', as caps 43, 43' have diameters greater than the diameters of tunnels 63, 63'. The user thus may pull upon grip 44 to extricate rods 42, 42' from body 30 to their fully extended position for use, as shown in FIGS. 3 and 4, at which time stop caps 43, 43' bump against rotator collars 64, 64' to prevent further extraction of rods 42, 42'.

When the rotator collars 64, 64' are rotated to a radial position which locks handle rods 42, 42' in the ready position, stop caps 43, 43' are also rotated into intermediate positions between respective rotator collars 64, 64' and backing plates 78, 78'. In this position, rods 42, 42' are maintained in the extended position by contact between stop caps 43, 43' and backing plates 78, 78'. When the rotator collars 64, 64' are rotated to place the rods 42, 42' in the storage position, each stop caps 43 is pivoted into confronting relation with a corresponding rod trough 86 in mounting member 60, as shown in FIG. 10. Upon the disengagement of the detent 41 from the recess 67 (FIG. 11), the rod 42 is free to slide out through the collar 64 and project through rod trough 86, thus passing between mounting member 60 and backing plate 78. The rod 42 is free to descend to the collapsed position shown in FIG. 5*b*.

When the user desires to retract the handle rods 42, 42' and grip 44 for storage and protection as shown in FIG. 5*b* (for instance, to check the luggage for departure from an airline terminal), the user first rotates the handle rods 42, 42' through the angle B to bring the handle into its fully upright storage position. The user then gives the handle grip 44 a firm downward tap or push, disengaging detent 41 from depression 67 to permit rod 42 to slide through rotator collar 64 and down into the main body 30.

FIGS. 5*b*, 6 and 9 show that rod sleeves 77, 77' are optionally provided to at least partially surround and protect rods 42, 42' when they are in the retracted position. Sleeves 77, 77' are attached to backing plates 78, 78' and may also be attached to body 30 or its frame. Sleeves 77, 77' separate the retracted rods 42,42' from the contents of interior space 33 of the body 30.

FIGS. 5*b* and 6 show that, when fully installed, much of the handle assembly is contained within interior space 33 and thus is concealed from view. Handle rods 42, 42', by reciprocating within tunnels 63, 63', can be retracted substantially entirely into body 30, while handle grip 44 remains exterior to the interior space 33 at all times.

An advantage of the invention is a safeguard against breakage provided by the pivotable handle assembly 40. In the event the main body 30 is tipped completely over toward the user, and falls to the ground, the grip 44 and rods 42, 42' will strike the ground before the back 34 does. The grip's collision with the ground disengages a detent holding the handle rods 42, 42' and grip 44 in the ready position, allowing them harmlessly to swing freely (to or toward the storage position), instead of fracturing or bending.

The operation of the apparatus may be briefly described. The luggage case of the invention may be retrieved from car trunk or airport luggage carousel while in the configuration shown in FIG. 5*b*, that is, with the handle assembly in the collapsed configuration. At this juncture, the cam ridge 61 on each ratchet block 62 is interlocked with the first cam groove 66 in each rotator collar 64. The user places the body 30 upon a supporting surface so that all four wheels 50, 50', 52, 52' are in contact therewith. The user grasps handle grip 44 and pulls upward and outward. Each rod 42 slides out from within its respective sleeve 77, passes between backing plate 78 and mounting member 60 via a rod trough 86, and is drawn through a rotator collar 64 until the detent 41 snaps into place within recess 67 within the collar 64. Rod 42 is barred against further extension by contact of stop cap 43 with rotator collar 64. The handle rods 42, 42 and handle grip 44 are thus maximally extended. The user pushes firmly downward on grip 44, which rotates each rotator collar 64 and causes each cam ridge 61 to move up and out of its respective first cam groove 66. The user pivots the handle rods 42, 42' downward through the angle B until cam ridge 61 snaps into place within the second cam groove 66'. The handle rods 42, 42' and grip are thus releasably locked into the use position. In the use position, the stop caps 43, 43' are moved into contact or near contact with the interior surface of respective backing plates 78, 78'. The user then may push or pull on the grip 44 to roll the luggage across the supporting surface, as shown in FIG. 4. A user's pushing force is translated down the handle rods 42, 42' to the stop caps 43, 43', thence to the backing plates 78, 78', and then through the mounting member 60 and/or sleeves 77, 77' to the frame of the case—resulting in the comfortable, easy, rolling movement of the case across the supporting surface.

To collapse the handle assembly, the process is repeated in reverse order. The handle rods 42, 42' are pivoted by the user to upward through angle B until each cam ridge 61 pops out of a second cam groove 66' and is pushed by spring 45 into first cam groove 66. The user then pushes on grip 44 in a direction parallel to the rods 42, 42', which releases each detent 41 from its respective recess 67. Each of stop caps 43, 43' is free to clear a respective backing plate 78, 78', and continued downward pushing by the user slides the rods 42, 42' through the rotator collars 64, 64' and the rod troughs 86, 86' until the grip 44 is snug against the body 30 and the rods 42, 42 are retracted within sleeves 77, 77', as depicted by the dashed lines of FIG. 5*b*.

Figure 12:
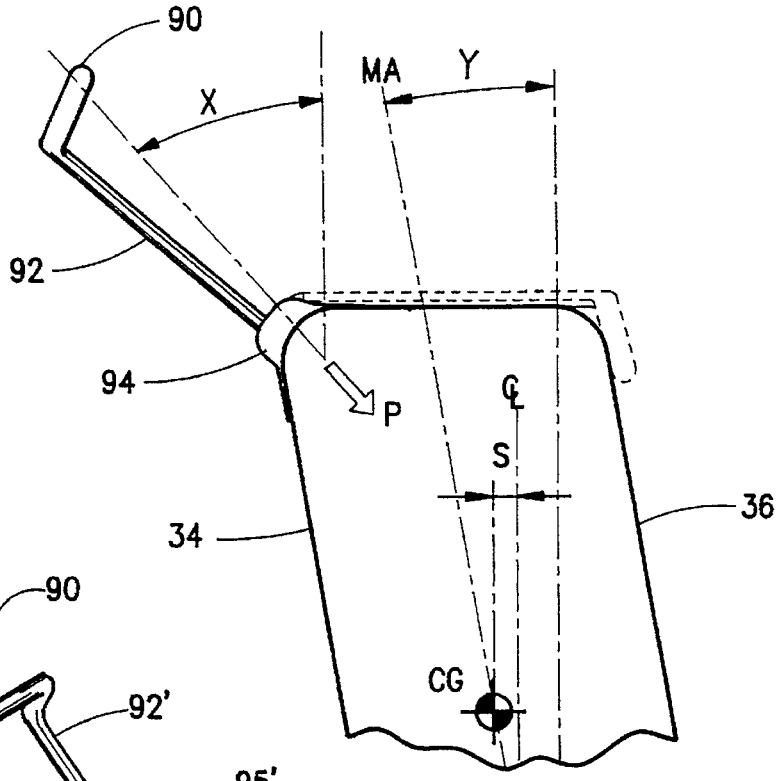
FIG. 12 is a partial schematic side view of the FIG. 1 embodiment, depicting an alternative embodiment of the pull handle assembly.
Figure 13:
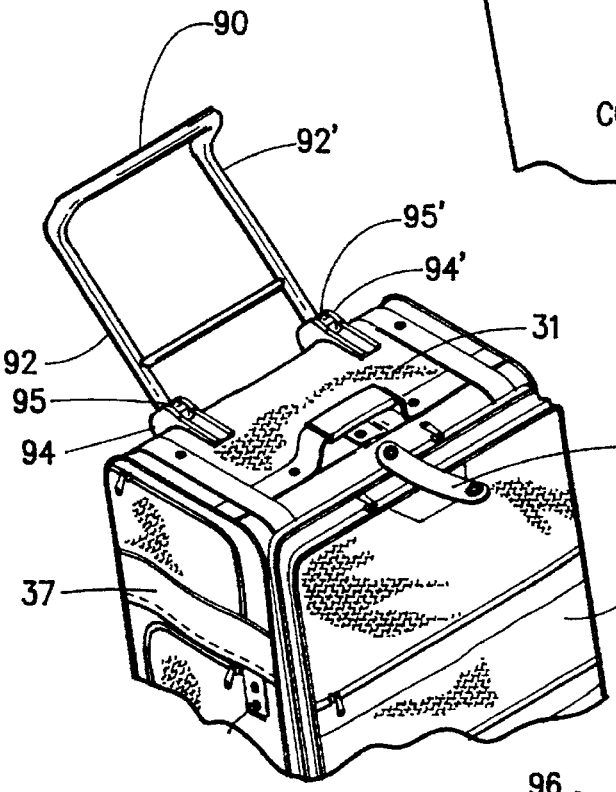
FIG. 13 is a partial top perspective view of the embodiment of FIG. 12.
Figure 14:
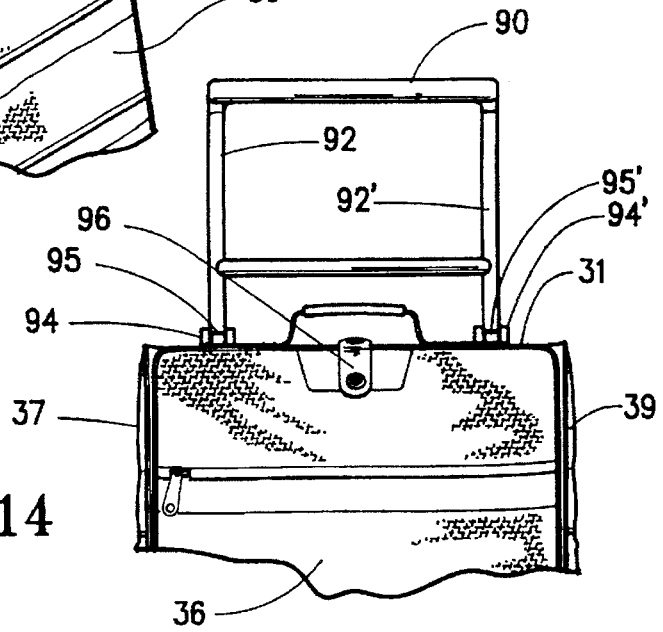
FIG. 14 is a front view of the embodiment of FIG. 13.

Alternative handle assemblies are within the scope of the invention. FIGS. 12–14 depict an alternative handle assembly that is simple in design and inexpensively manufactured. The alternative assembly includes a very generally "U"-shaped handle, composed of a pair of broadly spaced parallel handle bars 92, 92' connected together at their distal ends by a transverse grip bar 90. Combined reference to FIGS. 12 and 13 shows that the grip bar 90 itself has a broad shallow "U" shape disposed at an angle with respect to the plane containing handle bars 92, 92'. The angled position of the grip bar 90 relative to handle bars 92, 92' locates grip bar 90 at a desirable height above the supporting surface (e.g., about 94 cm) when the assembly is in the use position, and yet permits the handle assembly to be pivoted into an unobtrusive storage position atop the case 30, as shown in phantom in FIG. 12.

FIG. 12 also shows that the profile of the handle assembly consisting of bars 92, 92' and grip bar 90 is roughly in the shape of an "L" (although defining a somewhat non-perpendicular angle), so that when the assembly is pivoted into the stored position, bars 92, 92' lay substantially parallel to and in contact with the top 31, while the grip bar 90 wraps around the intersection of the front 36 and top 31 to lay snugly against the front 36. In this stored position, the handle assembly is stowed and protected while the case is stored in the cargo area of an aircraft, bus, etc.

Handle bars 92, 92' are pivotably attached to an upper portion of body 30. Pivotable connection is realized by the engagement of pivot pin pieces 95, 95', at the proximate ends of bars 92, 92', with pivot brackets 94, 94' mounted on the body (preferably to the frame). Pins extend laterally from pivot pin pieces 95, 95' into sockets within brackets 94, 94' to secure bars 92, 92' to the body 30, and yet to permit pivotal rotation of bars 92, 92' between the position extended for use, shown in solid lines in FIG. 12, and the stored position shown in phantom.

When the pivotable handle assembly is in the stored position, it may be there secured by means of the handle strap 96 shown in FIGS. 13 and 14. Handle strap 96 has one end permanently attached to top 31 or front 36. When grip bar 90 is disposed against body 30, flexible strap 96 may be wrapped around bar 90 and its free end may be buckled, snapped, or otherwise releasably secured to the top 31 to hold the stored handle assembly in place.

The fundamental objects and advantages of the invention are obtained with this alternative handle assembly. The center of gravity CG and angle of tilt Y are determined in substantially the same manner as with the preferred embodiment. When grip 90 is not within the same general plane as handle bars 92, 92', such as in the alternative configuration shown in FIG. 12, the handle angle X is defined in part by an imaginary line extending from the grip 90 to the point where the rods 92, 92' connect to body 30 (a line which is not collinear with the rods 92, 92'). When grip bar 90 and handle bars 92, 92' are pivoted to the "ready" or use position shown in solid lines in FIG. 12, the preferred angle X (between vertical and the line from grip 90 to pin pieces 95, 95') is the same as previously described, e.g., X in the range from about 10° to about 48° when angle Y, the tilt of the major axis of the body 30, is in the range of from about 6° to about 25°. More preferably, the handle assembly swings up from the top of the body to define an angle X between about 40° and about 45° from vertical, and most preferably about 42° (when angle Y is about 10°). The angle of tilt Y in many aesthetic embodiments of the invention, regardless of handle assembly type, will equal the angle C in FIG. 8, the tilt angle of front 36 and back 34 of body 30.

Spring operated detents (not shown in figures), such as ball-and-spring detents known in the art, are located at the interface between brackets 94, 94' and pin pieces 95, 95' to releasably lock the bars 92, 92' in the use position. Balls within brackets 94, 94' are spring biased into corresponding chamfered recesses in pivot pin pieces 95, 95' as the balls and recesses co-align when the rods 92, 92' are drawn to the use position. The engagement of the balls into the recesses locks the rods 92, 92' in the use position to permit the case to be pushed or pulled by the grip bar 90, yet an abrupt strike to the grip 90 pops the balls out of the recesses to unlock the handle assembly and allow it to pivot to the stored position.

FIG. 15 illustrates another alternative embodiment of the invention, desirable for its simplicity and reduced cost of manufacture. In this alternative embodiment, top 31 and bottom 32 define approximately right angles with front 36 and back 34, so that the side view of body 30 presents an easily manufactured, generally rectangular parallelepiped. The major geometrical and physical characteristics of this alternative body 30 are very similar to those described in FIG. 8 for the preferred embodiment, including the manner of locating the center of gravity CG and the major axis MA. Importantly, the center of gravity CG is still located such that a vertical line passing through it falls between front wheels 52, 52' and back wheels 50, 50'. In the embodiment of FIG. 15, the major axis MA of the case will be approximately perpendicular to both bottom 32 and top 31.

Handle rods 42, 42' are at all times parallel to (or even coplanar with) the back 34, permitting a simple, inexpensive handle assembly that is easily adjusted to accommodate user preferences. In addition to permitting the invention to be adapted for use by persons of varying heights, the adjustable handle also accommodates comfortable use of the case 30 in either a "push" or a "pull" mode of movement. We have determined that it is desirable to have the grip 44 at a slightly higher elevation when the case is being pushed than when it is being pulled behind the user.

In this embodiment, handle rods 42, 42', do not, and need not, pivot about any horizontal axis, but are slidable between a stored position adjacent to back 34 and an extended position for use. Handle rods 42, 42' and the back 34 depart from the vertical an equal number of degrees. In FIG. 15, the angle between vertical and the line running from grip 44 to the point where rods 42, 42' intersect the body 30 is denoted as angle Y'. When back 34 of body 30 is substantially parallel to the body's major axis MA, angle Y' approximately equals angle Y.

Because, as previously explained for the preferred embodiment, angle Y preferably is equal to or less than about 25° (due to stability limitations), angle Y' of the handle in FIG. 15 thus is likewise limited in this alternative embodiment to a number much less than the preferred size of angle X in the preferred embodiment (i.e., about 42° in FIG. 8). In this alternative embodiment, therefore, angle Y' cannot exceed approximately 25°. By empirical investigation and other evaluation, we have determined that, in embodiments where it is desired to have the handle angle Y' equal the body tilt angle Y, both angles Y' and Y should range from about 12° to about 25°, inclusive. Optimized performance is realized when angles Y and Y' both equal about 20°.

The proportional relationships between the height, width, and depth of this alternative, rectangular embodiment of body are altered somewhat from the preferred embodiment. We have determined that considerations of aesthetics are less restrictive, but considerations of stability are somewhat more restrictive, than in the preferred embodiment for proportions between depth and height and between depth and width. In this embodiment, the height preferably is between about 215% and about 260% of the depth, while the width is between about 155% and 175% of the depth.

Figure 16:
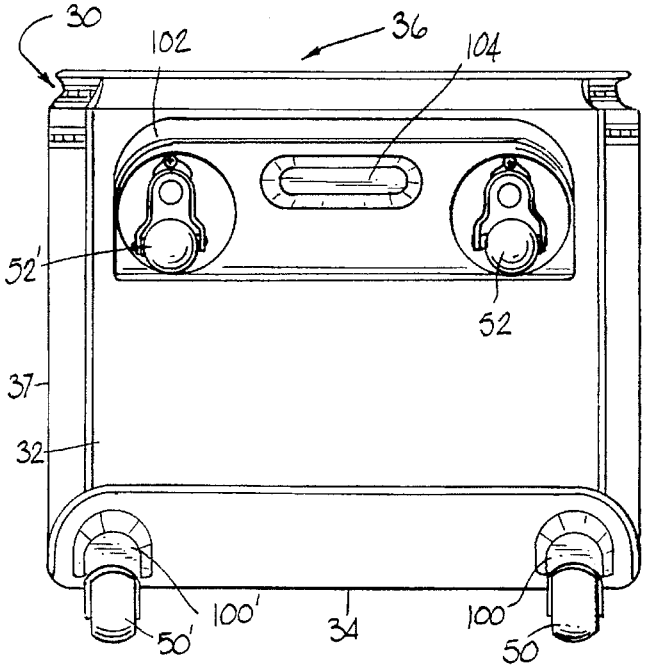
FIG. 16 is a bottom view of the embodiment of FIG. 15.

The shape of body 30 and its departure from vertical suggest the use of back wheel brackets 100, 100' and front wheel mount 102 as shown in FIGS. 15 and 16. Because bottom 32 need not be parallel to the supporting surface, the shapes of customized brackets 100, 100' and wheel mount 102 control the degree to which the major axis is inclined when all the wheels 50, 50', 52, 52' are in contact with the supporting surface. Front wheel mount 102, in particular, is configured to elevate the lower front corner of the body 30 the requisite amount to provide the desired angle Y, while allowing casters 52, 52' to pivot about approximately vertical axes.

FIG. 16 shows that the wheel mount 102 may be configured to offer other added advantages. The mount 102, which preferably is fashioned from a durable thermoplastic, may be shaped to provide circular wheel wells around each of the front wheels 52, 52', which preferably are pivoting casters. The wheel mount 102 also may be molded to define a concave grip area 104. The grip area 104 accommodate's user's fingers, easing the effort required to lift the case in a horizontal position, as into an automobile trunk or the like. FIG. 16 also shows that the front wheels 52, 52' may be closer together than back wheels 50, 50'.

The tilted disposition of this alternative embodiment of body 30 may advantageously be provided by modifying the bottom 32 and back 34 as shown in FIG. 20. Bottom 32 and back 34 are generally planar, but abbreviated to provide for intermediate corner portion 101. Corner portion 101 extends the width of the body and intersects with back 34, and also with bottom 32 at apex 103. Transition corner portion 101 may be mostly planar or, as shown in FIG. 20, may present a gently curved profile. When all the wheels 50, 50', 52, 52' are in contact with the supporting surface, apex 103 is the lowest point of body 30, as corner portion 101 rises from apex 103 toward back 34 while bottom 32 angles upward toward the front 36. Besides providing a manner for fixing the predetermined tilt of the body 30, such a configuration improves the capacity and appearance of a generally rectangular body case.

FIG. 20 shows the location of the imaginary plane denoted at A—A which contains the bottom 32. Also depicted is imaginary plane B—B which is parallel to the back 34 and, in most alternative embodiments of the invention, perpendicular to plane A—A. Wheel brackets 100, 100' are fixedly placed upon corner portion 101 to locate back wheels 50, 50' entirely permanently rearward (toward the user) of the back 34. Plane B—B is tangential to the surfaces of back wheels 50, 50' and is parallel to back 34; thus plane B—B is spaced away from back 34 by the distance w', which is the distance separating the surface of back wheels 50, 50' from the plane containing the back 34.

Wheel brackets 100, 100' are securely mounted to corner portion 101 also to locate the back wheels 50, 50' entirely above the plane A—A when all the wheels 50, 50', 52, 52' are in contact with the supporting surface. As shown in FIG. 20, the distance w separating plane A—A from a plane parallel to plane A—A and tangential to wheel 50' is the offset of back wheels 50, 50' from the bottom 32 of case 30.

An added advantage results from thus mounting the wheel brackets 100, 100' upon corner portion 101 in the configuration of FIG. 20. The added advantage is realized when case 30 is pushed or towed by the user in a two-wheel mode only, i.e., the case is rolled only upon back wheels 50, 50'. By offsetting the back wheels 50, 50' a distance w above the plane A—A, and a distance w' behind the back 34, the body 30 of the case may easily be pivoted from the four-wheel mode of movement to the two-wheeled mode, while minimizing the amount of weight thereby shifted to the user's arm(s). The reduction in the amount of weight formerly borne by the third and fourth wheels 52, 52' and shifted to the user's arm is accomplished by optimizing the location of back wheels 50, 50' with respect to body 30. This optimization must respect the limitations imposed by the need to easily store the case without obtrusive protuberance of the wheels 50, 50'. Accordingly, the object of this aspect of the invention is to optimize the distance between the back wheels 50, 50' and a vertical plane containing the center of gravity CG (FIG. 15) when the body is tipped toward the user for two-wheeled use, so that the weight of the case and its contents is balanced, or comfortably nearly so, upon the weight-bearing wheels 50, 50'. Since the brackets 100, 100' are immovably, non-pivotably, fixed to body 30 and the axes of rotation of wheels 50, 50' are fixed with respect to brackets 100, 100', the offset distances w and w' are invariable on a particular case, and are optimized and fixed at the time of construction. We have determined that, for a body about 68.5 cm±3.0 cm in height, the distance w should be between about 1.0 cm and about 2.0 cm, with the optimum distance w being about 1.1 cm. We have also determined that optimum user comfort in the two-wheeled mode of movement is realized when the distance w' is at least that necessary to permit mechanical clearance between wheels 50, 50' and corner portion 101, but not so large as to interfere with the practical boxing and storage of the case. Our analysis indicates that the optimum distance w' for a body about 68.5 cm±3.0 cm in height is about 0.6 cm.

Figure 17:
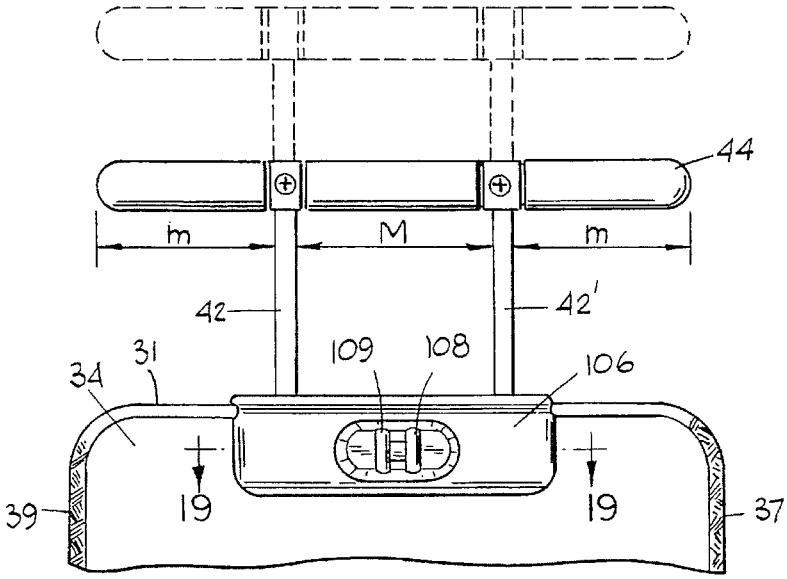
FIG. 17 is a partial back view of the embodiment of FIG. 15, showing the adjustability of the pull handle assembly.

FIG. 17 shows the dimensional and positional relationships between the grip 44 and the handle rods 42, 42' of this embodiment. Prior art pull handles typically have been adapted primarily for one-handed use for towing a wheeled case rather than pushing. Thus, luggage wheel handles commonly offer too small a grip for two-handed use. Also, known pull handles often rely on the tendency of a wheeled case to trail or track behind the user, and thus are steered with a handle that focuses pulling forces at about a single point on the case.

Figure 18:
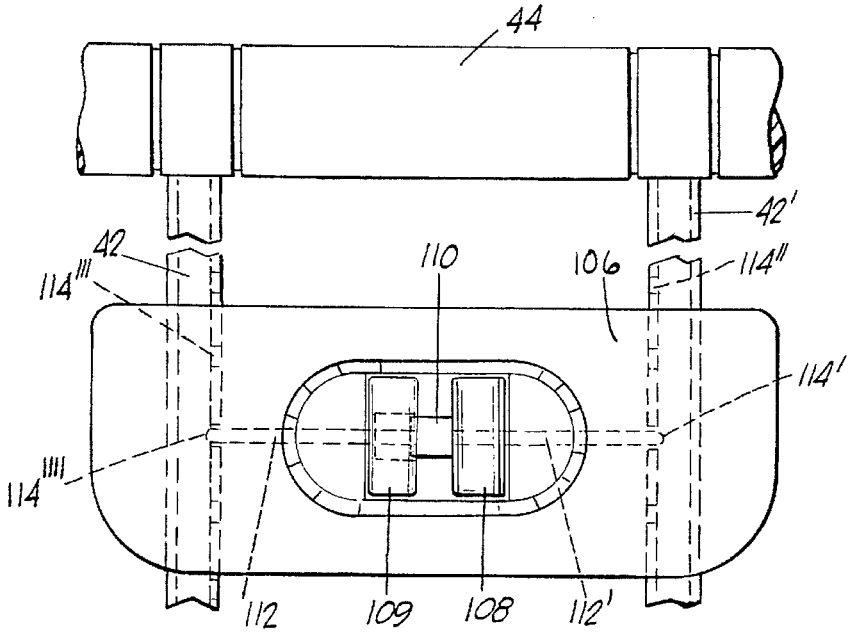
FIG. 18 is an enlarged view of a portion of the FIG. 17 embodiment.
Figure 19:
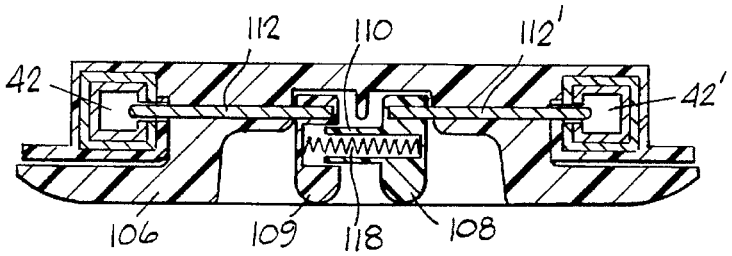
FIG. 19 is a plan sectional view of the embodiment of FIG. 17, taken substantially along section line 19—19 in FIG. 17.

The handle configuration depicted in FIGS. 17–19 offers advantages particular to the invention as well to the art of luggage design generally. As shown in FIG. 17, grip 44 has a length M+2 m (e.g., 33 cm) considerably longer than the distance M separating the rods 42, 42' (e.g. 13 cm), the grip 44 symmetrically extends laterally beyond the rods to provide the user a comfortable two-handed use; the user merely grasps the outer cantilevered portions of the grip 44. Additionally, the pushing force is directed to the body 30 at two separate locations via the spaced rods 42, 42', which enhances the user's directional steering of a pushed case. The user can comfortably grasp with one hand the portion of the grip 44 between the rods 42, 42' to pull the case behind him. The distance M separating the parallel rods 42, 42', which is slightly greater than the width of the average human hand, is comparatively smaller than most dual-rod handles known to the art, which reduces the tendency of the rods 42, 42' to slide in or out of bezel 106 at different rates or times with respect to each other, thus reducing the possibility the handle assembly will "rack" or bind while being retracted or withdrawn into case.

FIG. 17 also illustrates an adjustable handle assembly for use with the alternative embodiment of the invention shown in FIG. 15. Bezel 106 is mounted to body 30 at the intersection of top 31 with back 34. Bezel 106 wraps around both top 31 and back 34 to contain and guide various handle assembly features. As shown in the figures, holes through the upper surface of bezel 106 guide the up and down sliding movement therethrough of handle rods 42, 42'. The back surface of bezel 106 is configured to hold and guide handle release knobs 108, 109 and their associated parts.

The adjustability of the height of the grip 44 above the supporting surface is provided by the retractable engagement of a shafts 112, 112' into spaced apertures 114', 114", 114''', 114'''' disposed periodically along the interior sides of handle rods 42, 42'. Depending upon which pair of apertures (e.g., 114" and 114''', versus 114' and 114'''') are engaged by shafts 112, 112', grip 44 can be maintained at various adjusted heights, as suggested by the phantom and solid depictions of grip 44 in FIG. 17. As illustrated in FIG. 18, a plurality of apertures 114', 114", 114''', 114'''' are regularly spaced along a substantial portion of the length of a corresponding rod 42 or 42'. The distance a rod 42' extends through bezel 106 and out the body is adjustable incrementally in direct relation to the spaced separation of apertures 114', 114". Apertures are associated in corresponding pairs at equal distances above the supporting surface, such as apertures 114" and 114''', to provide for concurrent engagement of shafts 112, 112' into a corresponding pair of apertures 114', 114''''. With the ends of shafts 112, 112' inserted into apertures 114', 114'''', the rods 42, 42' are prevented from moving, maintaining grip 44 at the particular height desired.

The reciprocal movement of shafts 112, 112' is controlled by the user's manipulation of release knobs 108, 109. Knobs 108, 109 are movable horizontally a limited distance back and forth with respect to each other. A rigid tubular cylinder 110, which houses a spring 118, protrudes from one knob 108 into a an opening in the other knob 109. Each of handle release knobs 108, 109 is fixedly connected to a respective shaft 112' or 112. Pushing the knobs 108, 109 toward each other (as cylinder 110 slips into left knob 109) withdraws shafts 112, 112' from apertures 114', 114'''' and frees rods 42, 42' to slide up and down in bezel 106. As shown in FIG. 19, knobs 108, 109 are biased apart by the action of spring 118 compressedly disposed within cylinder 110 in contact with both knobs. As spring 118 constantly pushes knobs 108, 109 apart, the bias is transmitted to shafts 112, 112', which are thus pushed against rods 42, 42'. When the ends of the shafts 112, 112' align with any pair of apertures, spring 118 biases the ends of the shafts into the apertures, thus locking the rods 42, 42' in position. When it is desired to further adjust the position of grip 44, the user needs merely to pinch the knobs 108 and 109 toward each other, against the force of the spring. As the knobs draw toward each other, the ends of the shafts 112, 112' are retracted from apertures 114', 114'''', releasing rods 42, 42' for slidable adjustment. Upon the user's releasing knobs 108, 109, spring 118 again biases shafts 112, 112' outward against rods 42, 42'. Rods 42, 42' may then be moved up and down until shafts 112, 112' align with another pair of apertures 114", 114''' and engage therein under the force of spring 118.

Figure 7:
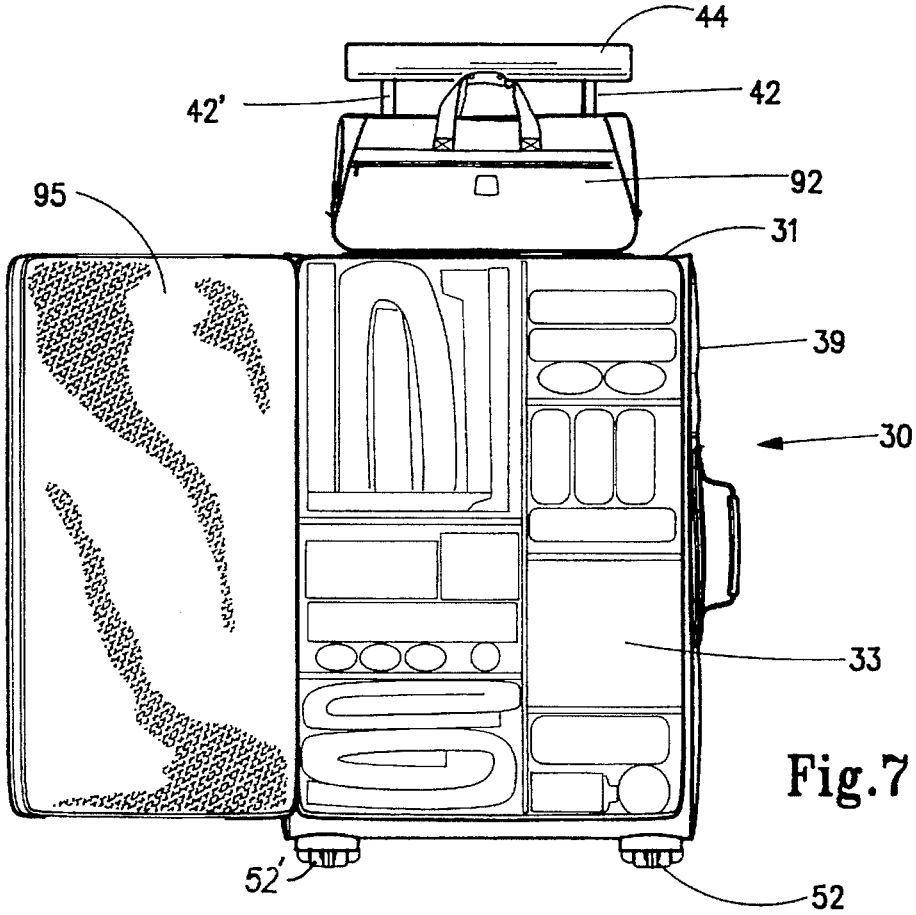
FIG. 7 is a front view of the FIG. 1 embodiment, with a cover in an open position to reveal certain interior features of the invention.

FIG. 7 shows a preferred manner of configuring the interior space 33 of main body 30. Interior space 33 may be supplied with any desirable array of vertical panels and/or horizontal shelves to promote easy packing and simple organization of the contents of body 30. In this embodiment, front 36 may be attached to body 30 by means of an integral hinge, hinges or other pivotal connection, so that the front 36 may swing out from body 30 in a door-like manner. Alternatively, front 36 may be integrally hinged along its bottom, near the bottom 32 of the case, so that the front folds out and down to lay upon the supporting surface while open. As shown in FIG. 7, the door panel 95 panel may swing out to allow the interior space 33 to be packed. Upon closure, door 95 may be temporarily secured by a circumferential zipper or other fasteners known in the art. Door panel 95 may be provided with inside pockets or suit holders.

It may be desirable to provide movable, removable, and/or collapsible shelves and panels within the interior space 33. Moveable organizational dividers allow the user to customize the division of interior space 33 to suit the user's particular packing needs and access priorities. Shelving and vertical dividers are encouraged by the present invention in a manner not encountered in the art, since the present invention offers stability in a mostly vertical case not provided in previous devices.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of the patents cited hereinabove are hereby incorporated by reference.

We claim:

1. In a wheeled upright luggage case having a main body with a back and with a depth dimension and a width dimension, each of which is less than a height dimension of the body, and a handle mounted at an upper portion of the body for moving the case on the wheels along a supporting surface, the luggage case, at least when packed with clothing and the like, having a center of gravity about in the geometric center of the body, the improvement comprising:

at least a pair of wheels, spaced along the width dimension, mounted to a first lower portion of the body;

at least one other wheel mounted on a second lower portion of the body at a distance along the depth dimension forward of the pair of wheels;

wherein the depth dimension is less than the width dimension, and wherein the body, when resting on the other wheel and the pair of wheels, tilts at an angle from vertical, and a vertical line passing through the center of gravity falls between the pair of wheels and the other wheel; and whereby the case can stand unattended on the wheels and pushed or pulled by the handle on at least some of the wheels.

2. The apparatus of claim 1 wherein the angle from vertical is between about 6 degrees and about 25 degrees.

3. The apparatus of claim 1 wherein the handle comprises:

a grip;

at least one rod means for connecting the grip to the main body, said rod means slidably positionable between a retracted position at least partially within the body and a position substantially extended from the body; and means for slidably coupling the rod means with the body.

4. The apparatus of claim 3 wherein the rod means comprises a pair of parallel rods separated by a distance, and wherein the grip comprises a length substantially greater than said distance.

5. The apparatus of claim 1 wherein the pair of wheels comprise a pair of fixed axis wheels.

6. The apparatus of claim 5 wherein the other wheel comprises a pivotable caster wheel.

7. The apparatus of claim 2 wherein the angle from vertical is between about 9 degrees and about 12 degrees.

8. The apparatus of claim 7 wherein the angle from vertical is about 10 degrees.

9. The apparatus of claim 2 wherein the first lower portion of the body and the second lower portion of the body define a bottom having a front edge and a back edge, and wherein the pair of wheels are attached to said bottom substantially adjacent to said back edge and the other wheel is attached to said bottom between said front edge and the pair of wheels.

10. The apparatus of claim 9 wherein the bottom is substantially parallel to the supporting surface.

11. The apparatus of claim 10 wherein the body further comprises a top substantially parallel to the bottom.

12. The apparatus of claim 3 further comprising means for pivoting the rod means between the extended position and a use position defining an angle relative to the back.

13. The apparatus of claim 12 further comprising means for releasably locking the rod means in the extended position and in the use position.

14. The apparatus of claim 12 wherein the rod means in the use position define an angle from the vertical of between about 10 degrees and about 48 degrees.

15. The apparatus of claim 14 wherein the rods means in the use position define an angle from the vertical of between about 40 degrees and about 45 degrees.

16. The apparatus of claim 15 wherein the rod means in the use position define an angle from the vertical of about 42 degrees.

17. The apparatus of claim 7 wherein the width dimension is between about 170% and about 180% of the depth dimension.

18. The apparatus of claim 7 wherein the height dimension is between about 220% and about 230% of the depth dimension.

19. The apparatus of claim 2 wherein the angle from vertical is between about 12 degrees and about 25 degrees.

20. The apparatus of claim 19 wherein the angle from vertical is about 20 degrees.

21. The apparatus of claim 19 wherein:

the second lower portion of the body defines a bottom; and the first lower portion of the body comprises an intermediate corner portion extending between and intersecting the back and said bottom.

22. The apparatus of claim 21 wherein the pair of wheels are at least partially rearward of an imaginary plane containing the back.

23. The apparatus of claim 22 wherein the pair of wheels are entirely rearward of an imaginary plane containing the back.

24. The apparatus of claim 22 wherein the pair of wheels are at least partially above an imaginary plane containing the bottom.

25. The apparatus of claim 24 wherein the imaginary plane containing the bottom is substantially perpendicular to the imaginary plane containing the back.

26. The apparatus of claim 25 wherein the body further comprises a top substantially parallel to the bottom.

27. The apparatus of claim 19 wherein the width dimension is between about 155% and about 175% of the depth dimension.

28. The apparatus of claim 19 wherein the height dimension is between about 215% and about 260% of the depth dimension.

29. In an upright luggage case having a main body with a back, a front, a top and a bottom, and the luggage case, when at least partially loaded with personal items, also having a center of gravity at about the geometric center of the body, an improvement comprising:

at least two back wheels attached to the bottom substantially proximate to the back of the body;

at least one front for wheeling means mounted upon the bottom substantially proximate to the front of the body;

the back of the body extending between the top and the bottom and disposed at a first substantial angle from the vertical when all the wheels are in contact with a generally horizontal supporting surface;

the front of the body extending between the top and the bottom and disposed at a second substantial angle from the vertical when all the wheels are in contact with the supporting surface; and handle means, mounted at an upper end of the body substantially proximate to the back of the body, for moving the case upon the wheels along the supporting surface;

wherein an imaginary vertical line passing through the center of gravity intersects the bottom of the body.

30. The apparatus of claim 29 wherein the main body comprises a depth dimension, a width dimension, and a height dimension, wherein the width dimension is in the range from about 155% of the depth dimension to about 175% of the depth dimension.

31. The apparatus of claim 29 wherein the main body comprises a depth dimension, a width dimension, and a height dimension, and wherein the height dimension is in the range from about 215% of the depth dimension to about 260% of the depth dimension.

32. The apparatus of claim 29 further comprising substantially horizontal shelves within case.

33. The apparatus of claim 29 wherein the bottom is substantially parallel to the supporting surface.

34. The apparatus of claim 33 wherein the top is substantially parallel to the bottom.

35. The apparatus of claim 29 wherein the top is substantially perpendicular to the back.

36. The apparatus of claim 29 wherein each of the back wheels comprises a fixed axis wheel.

37. The apparatus of claim 29 wherein the front means for wheeling comprises caster wheels.

38. The apparatus of claim 37 wherein the caster wheels comprise at least two caster wheels.

39. The apparatus of claim 29 wherein the handle means comprises:

a transverse handle grip;

at least one rod means for connecting said grip to the main body, said rod means slidably positionable between a retracted position at least partially within the main body and a position substantially extended from the main body; and means for coupling said rod means with the main body.

40. The apparatus of claim 39 wherein the rod means is substantially parallel to the back of the body when in the retracted position and also when in the extended position.

41. The apparatus of claim 39 wherein the rod means for connecting comprise a pair of parallel rods separated by a distance, and further wherein the handle grip is disposed upon the ends of the rods.

42. The apparatus of claim 41 wherein the handle grip comprises a length substantially greater than the distance separating the rods.

43. The apparatus of claim 41 further comprising means for releasably holding the rods in a plurality of positions between the substantially extended position and the retracted position.

44. The apparatus of claim 43 wherein the means for releasably holding the rods in a plurality of positions comprises:

a plurality of catches means disposed along the rods;

a pair of bolts disposed upon the body between the rods and selectively engageable with said catches;

means for controllably biasing the bolts toward the rods.

45. The apparatus of claim 44 wherein the catches comprise a plurality of regularly spaced indents, the bolts comprise horizontally disposed slidable shafts, and the means for controllably biasing comprises:

a resilient spring disposed between the shafts; and knobs disposed upon respective shafts.

46. The apparatus of claim 29 wherein the first substantial angle from the vertical is between about 12 degrees and about 25 degrees.

47. The apparatus of claim 46 wherein the second substantial angle from the vertical is between about 12 degrees and about 25 degrees.

48. The apparatus of claim 47 wherein the first substantial angle is substantially equal to the second substantial angle.

49. The apparatus of claim 47 wherein the first substantial angle is about 20 degrees.

50. The apparatus of claim 39 wherein the means for coupling further comprises means for pivoting the rods between the extended position and a use position defining an angle relative to the back.

51. The apparatus of claim 50 wherein the first substantial angle from the vertical is between about 9 degrees and about 12 degrees.

52. The apparatus of claim 51 wherein the rods in the use position define an angle from the vertical of between about 10 degrees and about 48 degrees.

53. The apparatus of claim 52 wherein the rods in the use position define an angle from the vertical of between about 40 degrees and about 45 degrees.

54. The apparatus of claim 52 wherein the first substantial angle from the vertical is about 10 degrees.

55. The apparatus of claim 54 wherein the rods in the use position define an angle from the vertical of about 42 degrees.

56. The apparatus of claim 50 wherein the means for coupling further comprises means for releasably locking the rods in the extended position and in the use position defining the angle relative to the back.

57. The apparatus of claim 56 wherein the means for releasably locking comprises:

a mounting member attached to the main body;

a one block member disposed within the mounting member;

a collar, radially movable with respect to and in contact with the block member, said collar rotatable within the mounting member and defining a rod tunnel through the collar in which one of the rods is slidably disposed;

cam means for engaging the collar with the block member;

means for biasing the block against the collar; and detent means upon the rod and the collar for releasably arresting the sliding of the rod through the collar.

58. An article of upright wheeled luggage for transporting personal items across a supporting surface, comprising a main body having a front, a back, two sides, a top, and a bottom, said bottom comprising a front edge and a back edge, said body defining an interior space in which the personal items may be contained, the body having a major axis spaced between the front and the back, and the luggage and personal items contained within the interior space having a center of gravity, said article of luggage comprising:

at least two back wheels attached to the bottom substantially adjacent to the back edge; and front means for wheeling mounted upon the bottom between the front edge and the back wheels;

wherein when the wheels and the front means for wheeling are engaging a horizontal supporting surface, the major axis is tilted at an angle from the vertical of between about 6 degrees and about 25 degrees; and wherein the center of gravity is above the bottom and between the back wheels and the front means for wheeling.

59. The article of claim 58 further comprising handle means mounted at an upper end of the main body for moving the case on the wheels along the supporting surface, said handle means comprising:

a transverse handle grip;

at least one rod means for connecting said grip to the main body, said rod means slidably positionable between a retracted position at least partially within the main body and a position substantially extended from the main body; and means for coupling said rod means with the main body.

60. The article of claim 59 wherein:

the rod means for connecting comprise a pair of parallel rods separated by a distance; and the handle grip is disposed upon the ends of the rods and comprises a length substantially greater than the distance separating the rods.

61. The article of claim 59 further comprising means for releasably holding the rods in a plurality of positions between the substantially extended position and the retracted position; said means for releasably holding comprising:

a plurality of catches disposed along the rods;

a pair of bolts movably disposed upon the body and between the rods and selectively engageable with said catches;

means for controllably biasing said bolts toward the rods.

62. The article of claim 61 wherein the catches comprise a plurality of regularly spaced indents, the bolts comprise horizontally slidable shafts, and the means for controllably biasing comprises:

a resilient spring disposed between the shafts; and knobs disposed upon respective shafts.

63. The article of claim 60 wherein the major axis is tilted at an angle from the vertical of between about 12 degrees and about 25 degrees.

64. The article of claim 60 wherein the major axis is tilted at an angle from the vertical of about 20 degrees.

65. The article of claim 59 further comprising means for pivoting the rods between the extended position substantially parallel to the back and a use position defining an angle relative to the back.

66. The article of claim 65 wherein the rods in the use position define an angle from the vertical of between about 10 degrees and about 48 degrees.

67. The article of claim 66 wherein the major axis is tilted at an angle from the vertical of between about 9 degrees and about 12 degrees.

68. The article of claim 67 wherein the rods in the use position define an angle from the vertical of between about 40 degrees and about 45 degrees.

69. The article of claim 65 further comprising means for releasably locking the rods in the extended position and in the use position defining the angle relative to the back.

70. The article of claim 69 wherein the means for releasably locking comprises:

a mounting member attached to the main body;

a one block member disposed within the mounting member;

a collar, radially movable with respect to and in contact with the block member, said collar rotatable within the mounting member and defining a rod tunnel through the collar in which one of the rods is slidably disposed;

cam means for engaging the collar with the block member;

means for biasing the block against the collar; and detent means upon the rod and the collar for releasably arresting the sliding of the rod through the collar.

71. The article of claim 58 comprising handle means mounted at an upper end of the main body for moving the case on the wheels along the supporting surface, said handle means comprising:

a transverse handle grip;

at least one rod means for connecting the grip to the main body, said rod means pivotably positionable between a retracted position substantially parallel and adjacent to the top and a use position substantially extended from the main body; and pivot means for mounting the rods to the body.

72. The article of claim 71 wherein the handle grip is substantially adjacent to the front of the body when the rods are in the retracted position.

73. The article of claim 71 wherein the major axis is tilted at an angle from the vertical of between about 9 degrees and about 12 degrees, and the rods in the use position define an angle from the vertical of between about 40 degrees and about 45 degrees.

74. A wheeled luggage case comprising:

a main body defining an interior space for containing personal items, the body comprising a top and a bottom which define a height dimension, said body further comprising:

a width dimension less than the height dimension, and a depth dimension less than said width dimension;

a center of gravity located within the interior space; and a major axis extending between the top and the bottom and defining an angle of tilt with respect to vertical;

at least two back wheels connected to the body; and at least one front wheel disposed upon the bottom, forward of the back wheels;

wherein a vertical line through the center of gravity passes between the front wheel and the back wheels, and wherein the angle of tilt is between about 6 degrees and about 25 degrees.

75. The luggage case of claim 74 further comprising a wheel handle for moving the case across a supporting surface, said handle comprising:

a grip;

a pair of parallel rods connecting the grip to the main body, said rods slidably positionable between a retracted position at least partially within the body and a position substantially extended from the body; and means for slidably coupling the rod means with the body.

76. The luggage case of claim 74 wherein each of the back wheels comprises a fixed axis wheel and each front wheel comprises a pivotable caster wheel.

77. The luggage case of claim 74 wherein the body comprises a bottom having a front edge and a back edge, and wherein the back wheels are attached to the bottom substantially adjacent to said back edge and the front wheel is attached to the bottom between said front edge and the back wheels.

78. The luggage case of claim 77 wherein the angle of tilt is between about 9 degrees and about 12 degrees.

79. The luggage case of claim 78 wherein the bottom is substantially parallel to the supporting surface.

80. The luggage case of claim 75 further comprising means for pivoting the rods between the extended position and a use position defining an angle with the back.

81. The luggage case of claim 80 wherein the angle of tilt is between about 9 degrees and about 12 degrees, and the rods in the use position define an angle from the vertical between about 40 degrees and about 45 degrees.

82. The luggage case of claim 74 wherein the body further comprises a back and an intermediate corner portion disposed between said back and the bottom, and wherein the back wheels are connected to said intermediate corner portion.

83. The luggage case of claim 82 wherein the angle of tilt is between about 12 degrees and about 25 degrees.

84. The luggage case of claim 83 wherein the back wheels are at least partially rearward of an imaginary plane containing the back.

85. The luggage case of claim 83 wherein the back wheels are at least partially above an imaginary plane containing the bottom.

* * * * *